US009863228B2

(12) United States Patent
Shampine et al.

(10) Patent No.: US 9,863,228 B2
(45) Date of Patent: Jan. 9, 2018

(54) SYSTEM AND METHOD FOR DELIVERING TREATMENT FLUID

(71) Applicant: SCHLUMBERGER TECHNOLOGY CORPORATION, Sugar Land, TX (US)

(72) Inventors: Rod Shampine, Houston, TX (US); Edward Leugemors, Needville, TX (US); Timothy M. Lesko, Conway, AR (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 265 days.

(21) Appl. No.: 14/343,341

(22) PCT Filed: Mar. 8, 2013

(86) PCT No.: PCT/US2013/029833
§ 371 (c)(1),
(2) Date: Mar. 6, 2014

(87) PCT Pub. No.: WO2013/134624
PCT Pub. Date: Sep. 12, 2013

(65) Prior Publication Data

US 2014/0216736 A1 Aug. 7, 2014

Related U.S. Application Data

(63) Continuation-in-part of application No. 13/415,025, filed on Mar. 8, 2012.

(51) Int. Cl.
*E21B 43/26* (2006.01)

(52) U.S. Cl.
CPC ..... *E21B 43/26* (2013.01); *Y10T 137/0318* (2015.04); *Y10T 137/8766* (2015.04)

(58) Field of Classification Search
CPC ..... E21B 43/25; E21B 43/26; E21B 43/30
See application file for complete search history.

(56) References Cited

U.S. PATENT DOCUMENTS 2,193,775 A 3/1940 Stratford
2,513,944 A 7/1950 Kessler
(Continued)

FOREIGN PATENT DOCUMENTS

CA 2710988 7/2009
CN 1280240 A 1/2001
(Continued)

OTHER PUBLICATIONS

Kirk-Othmer Encyclopedia of Chemical Technology, vol. 17, pp. 143-167 (1982), "Petroleum (Drilling Fluids)".
(Continued)

*Primary Examiner* — Jennifer H Gay
(74) *Attorney, Agent, or Firm* — Michael L. Flynn; Rachel E. Greene; Robin Nava

(57) ABSTRACT

A system includes a regional blending facility having a number of bulk receiving facilities, where each bulk facility receives and stores a particle type having a distinct size modality, a bulk moving device that transfers particles between the bulk receiving facilities and of a blending/continuously receiving vessel and/or a mixer, and a carrying medium vessel. The mixer receives particles from the blending/continuously receiving vessel and/or the bulk moving device, receives a carrying medium from the carrying medium vessel, mixes the particles with the carrying medium, and provides a mixed treatment fluid. The system includes a fluid conduit that fluidly couples a wellsite location with the regional blending facility, where the fluid conduit delivers the mixed treatment fluid to the wellsite
(Continued)

and/or delivers produced fluid from a wellbore positioned at the wellsite to the regional blending facility.

20 Claims, 12 Drawing Sheets

(56) References Cited

U.S. PATENT DOCUMENTS

RE24,570 E 11/1958 Mangold et al.
2,905,245 A 9/1959 De Priester
3,362,475 A 1/1968 Huitt
3,434,540 A 3/1969 Stein
3,675,717 A 7/1972 Goins, Jr.
3,887,474 A 6/1975 Senfe et al.
3,937,283 A 2/1976 Blauer et al.
4,051,900 A 10/1977 Hankins
4,387,769 A 6/1983 Erbstoesser et al.
4,506,734 A 3/1985 Nolte
4,526,695 A 7/1985 Erbstoesser et al.
4,606,407 A 8/1986 Shu
4,652,257 A 3/1987 Chang
4,665,988 A 5/1987 Murphey et al.
4,670,166 A 6/1987 McDougall et al.
4,718,490 A 1/1988 Uhri
4,738,897 A 4/1988 McDougall et al.
4,785,884 A 11/1988 Armbruster
4,845,981 A * 7/1989 Pearson ..... B01F 15/00207 166/308.1
4,848,467 A 7/1989 Cantu et al.
4,867,241 A 9/1989 Strubhar
4,883,124 A 11/1989 Jennings, Jr.
4,917,185 A 4/1990 Jennings, Jr. et al.
4,951,751 A 8/1990 Jennings, Jr.
4,957,165 A 9/1990 Cantu et al.
4,968,353 A 11/1990 Kawasaki et al.
4,968,354 A 11/1990 Nishiura et al.
4,977,961 A 12/1990 Avasthi
4,986,355 A 1/1991 Casad et al.
5,036,920 A 8/1991 Cornette et al.
5,095,987 A 3/1992 Weaver et al.
5,161,618 A 11/1992 Jones et al.
5,188,837 A 2/1993 Domb
5,238,067 A 8/1993 Jennings, Jr.
5,325,921 A 7/1994 Johnson et al.
5,330,005 A 7/1994 Card et al.
5,332,037 A 7/1994 Schmidt et al.
5,333,689 A 8/1994 Jones et al.
5,365,435 A * 11/1994 Stephenson ..... B01F 15/00123 700/265
5,415,228 A 5/1995 Price et al.
5,439,055 A 8/1995 Card et al.
5,492,178 A 2/1996 Nguyen et al.
5,501,274 A 3/1996 Nguyen et al.
5,501,275 A 3/1996 Card et al.
5,507,342 A 4/1996 Copeland et al.
5,515,920 A * 5/1996 Luk ..... E21B 43/267 166/177.5
5,518,996 A 5/1996 Maroy et al.
5,551,516 A 9/1996 Norman et al.
5,629,271 A 5/1997 Dobson, Jr. et al.
5,713,416 A 2/1998 Chatterji et al.
5,741,758 A 4/1998 Pakulski
5,893,416 A 4/1999 Read
5,908,073 A 6/1999 Nguyen et al.
5,922,652 A 7/1999 Kowalski et al.
5,934,376 A 8/1999 Nguyen et al.
5,964,291 A 10/1999 Bourne et al.
5,979,557 A 11/1999 Card et al.
6,059,034 A 5/2000 Rickards et al.
6,114,410 A 9/2000 Betzold
6,156,805 A 12/2000 Smith et al.
6,172,011 B1 1/2001 Card et al.
6,209,643 B1 4/2001 Nguyen et al.
6,209,646 B1 4/2001 Reddy et al.
6,236,894 B1 * 5/2001 Stoisits ..... G05B 13/0265 166/52
6,239,183 B1 5/2001 Farmer et al.
6,258,859 B1 7/2001 Dahayanake et al.
6,279,656 B1 8/2001 Sinclair et al.
6,302,207 B1 10/2001 Nguyen et al.
6,326,335 B1 12/2001 Kowalski et al.
6,328,105 B1 12/2001 Betzold
6,330,916 B1 12/2001 Rickards et al.
6,364,020 B1 4/2002 Crawshaw et al.
6,379,865 B1 4/2002 Mao et al.
6,380,136 B1 4/2002 Bates et al.
6,435,277 B1 8/2002 Qu et al.
6,439,309 B1 8/2002 Matherly et al.
6,446,722 B2 9/2002 Nguyen et al.
6,464,009 B2 10/2002 Bland et al.
6,482,517 B1 11/2002 Anderson
6,506,710 B1 1/2003 Hoey et al.
6,543,538 B2 4/2003 Tolman et al.
6,559,245 B2 5/2003 Mao et al.
6,599,863 B1 7/2003 Palmer et al.
6,644,844 B2 * 11/2003 Neal ..... B01F 3/1221 366/10
6,656,265 B1 12/2003 Garnier et al.
6,703,352 B2 3/2004 Dahayanake et al.
6,719,054 B2 4/2004 Cheng et al.
6,723,683 B2 4/2004 Crossman et al.
6,725,930 B2 4/2004 Boney et al.
6,742,590 B1 6/2004 Nguyen
6,776,235 B1 8/2004 England
6,818,594 B1 11/2004 Freeman et al.
6,828,280 B2 12/2004 England et al.
6,860,328 B2 3/2005 Gonzalez et al.
6,874,578 B1 4/2005 Garnier et al.
6,877,560 B2 4/2005 Nguyen et al.
6,938,693 B2 9/2005 Boney et al.
6,989,195 B2 1/2006 Anderson
7,004,255 B2 2/2006 Boney
7,028,775 B2 4/2006 Fu et al.
7,044,220 B2 5/2006 Nguyen et al.
7,044,224 B2 5/2006 Nguyen
7,049,272 B2 5/2006 Sinclair et al.
7,060,661 B2 6/2006 Dobson, Sr. et al.
7,066,260 B2 6/2006 Sullivan et al.
7,084,095 B2 8/2006 Lee et al.
7,148,185 B2 12/2006 Fu et al.
7,166,560 B2 1/2007 Still et al.
7,178,596 B2 2/2007 Blauch et al.
7,213,651 B2 5/2007 Brannon et al.
7,219,731 B2 5/2007 Sullivan et al.
7,237,610 B1 7/2007 Saini et al.
7,257,596 B1 8/2007 Williams et al.
7,261,157 B2 8/2007 Nguyen et al.
7,265,079 B2 9/2007 Willberg et al.
7,267,170 B2 9/2007 Mang et al.
7,275,596 B2 10/2007 Willberg et al.
7,284,611 B2 10/2007 Reddy et al.
7,290,615 B2 11/2007 Christanti et al.
7,294,347 B2 11/2007 Menjoge et al.
7,303,018 B2 12/2007 Cawiezel et al.
7,345,012 B2 3/2008 Chen et al.
7,373,991 B2 5/2008 Vaidya et al.
7,379,853 B2 * 5/2008 Middya ..... E21B 43/00 702/13
7,398,826 B2 7/2008 Hoefer et al.
7,405,183 B2 7/2008 Hanes, Jr.
7,419,937 B2 9/2008 Rimmer et al.
7,451,812 B2 11/2008 Cooper et al.
7,482,311 B2 1/2009 Willberg et al.
7,493,955 B2 2/2009 Gupta et al.
7,510,009 B2 3/2009 Cawiezel et al.
7,528,096 B2 5/2009 Brannon et al.
7,543,640 B2 6/2009 MacDougall
7,559,369 B2 7/2009 Roddy et al.
7,565,929 B2 7/2009 Bustos et al.
7,581,590 B2 9/2009 Lesko et al.
7,624,802 B2 12/2009 McCrary et al.
7,644,761 B1 1/2010 Gu et al.
7,703,531 B2 4/2010 Huang et al.

(56) References Cited

U.S. PATENT DOCUMENTS 7,784,541 B2 8/2010 Hartman et al.
7,789,146 B2 9/2010 Panga et al.
7,806,182 B2 10/2010 Waters et al.
7,833,947 B1 11/2010 Kubala
7,836,949 B2 11/2010 Dykstra
7,841,394 B2 11/2010 McNeel et al.
7,923,415 B2 4/2011 Panga et al.
7,931,082 B2 4/2011 Surjaatmadja
7,931,088 B2 4/2011 Stegemoeller et al.
7,954,548 B2 6/2011 Curimbaba et al.
7,973,991 B2 7/2011 Watanabe
8,008,234 B2 8/2011 Panga et al.
8,119,574 B2 2/2012 Panga et al.
8,141,640 B2 * 3/2012 Abad ..... C09K 8/03 166/275
8,167,043 B2 5/2012 Willberg et al.
8,168,570 B2 5/2012 Barron et al.
8,210,249 B2 7/2012 Panga et al.
8,322,410 B2 * 12/2012 Abad ..... C09K 8/03 166/53
2003/0134751 A1 7/2003 Lee et al.
2004/0060702 A1 4/2004 Kotlar et al.
2004/0074644 A1 4/2004 Kotlar et al.
2004/0074646 A1 4/2004 Kotlar et al.
2004/0152601 A1 8/2004 Still et al.
2004/0168811 A1 * 9/2004 Shaw ..... E21B 41/02 166/368
2004/0209780 A1 10/2004 Harris et al.
2004/0261993 A1 12/2004 Nguyen
2004/0261995 A1 12/2004 Nguyen et al.
2004/0261996 A1 12/2004 Munoz, Jr. et al.
2005/0027499 A1 2/2005 Bourbiaux et al.
2005/0103496 A1 5/2005 Todd et al.
2005/0130845 A1 6/2005 Freeman et al.
2005/0130848 A1 6/2005 Todd et al.
2005/0161220 A1 7/2005 Todd et al.
2005/0166961 A1 * 8/2005 Means ..... E21B 37/06 137/13
2005/0172699 A1 8/2005 Hu et al.
2005/0233895 A1 10/2005 Mertens et al.
2005/0252651 A1 11/2005 Bosma et al.
2005/0252659 A1 11/2005 Sullivan et al.
2006/0006539 A1 1/2006 Matsui et al.
2006/0048943 A1 3/2006 Parker et al.
2006/0048944 A1 3/2006 van Batenburg et al.
2006/0052251 A1 3/2006 Anderson et al.
2006/0054324 A1 3/2006 Sullivan et al.
2006/0058197 A1 3/2006 Brown et al.
2006/0073980 A1 4/2006 Brannon et al.
2006/0113078 A1 6/2006 Nguyen et al.
2006/0124302 A1 6/2006 Gupta et al.
2006/0151173 A1 7/2006 Slabaugh et al.
2006/0157243 A1 7/2006 Nguyen
2006/0175059 A1 8/2006 Sinclair et al.
2006/0185848 A1 8/2006 Surjaatmadja et al.
2006/0289160 A1 12/2006 van Batenburg et al.
2007/0017675 A1 1/2007 Hammami et al.
2007/0029086 A1 2/2007 East, Jr.
2007/0039733 A1 2/2007 Welton et al.
2007/0042912 A1 2/2007 Welton et al.
2007/0044963 A1 3/2007 MacDougall
2007/0125543 A1 * 6/2007 McNeel ..... E21B 43/25 166/308.3
2007/0125544 A1 * 6/2007 Robinson ..... E21B 43/26 166/308.3
2007/0201305 A1 8/2007 Heilman et al.
2007/0238623 A1 10/2007 Saini et al.
2007/0289740 A1 * 12/2007 Thigpen ..... E21B 37/06 166/250.01
2008/0000391 A1 1/2008 Drochon
2008/0000638 A1 1/2008 Burukhin et al.
2008/0053657 A1 3/2008 Alary et al.
2008/0066910 A1 3/2008 Alary et al.
2008/0093073 A1 4/2008 Bustos et al.
2008/0103065 A1 5/2008 Reddy et al.
2008/0108520 A1 5/2008 Fu
2008/0121395 A1 5/2008 Reddy et al.
2008/0135250 A1 6/2008 Bosma et al.
2008/0162099 A1 * 7/2008 Vega Velasquez ..... E21B 49/00 703/10
2008/0210423 A1 9/2008 Boney
2008/0236818 A1 * 10/2008 Dykstra ..... E21B 43/267 166/252.1
2008/0280788 A1 11/2008 Parris et al.
2008/0280790 A1 11/2008 Mirakyan et al.
2008/0314594 A1 12/2008 Still et al.
2008/0318026 A1 12/2008 Dai et al.
2009/0008095 A1 1/2009 Duncum et al.
2009/0025394 A1 1/2009 Bonzani et al.
2009/0025932 A1 1/2009 Panga et al.
2009/0025934 A1 1/2009 Hartman et al.
2009/0095482 A1 * 4/2009 Surjaatmadja ..... E21B 43/25 166/305.1
2009/0107671 A1 4/2009 Waters et al.
2009/0194273 A1 * 8/2009 Surjaatmadja ..... E21B 43/26 166/250.1
2009/0294126 A1 12/2009 Dalrymple et al.
2010/0000735 A1 1/2010 Weaver et al.
2010/0087341 A1 4/2010 Alary et al.
2010/0087342 A1 4/2010 Alary et al.
2010/0089580 A1 4/2010 Brannon et al.
2010/0126722 A1 5/2010 Cornelissen et al.
2010/0163225 A1 7/2010 Abad et al.
2010/0200247 A1 8/2010 Dybevik et al.
2010/0252259 A1 10/2010 Horton
2010/0300688 A1 12/2010 Panga et al.
2011/0005760 A1 1/2011 Hartman et al.
2011/0028357 A1 2/2011 Abad et al.
2011/0036577 A1 2/2011 Barmatov et al.
2011/0053813 A1 3/2011 Panga et al.
2011/0063942 A1 3/2011 Hagan et al.
2011/0083849 A1 4/2011 Medvedev et al.
2011/0098202 A1 4/2011 James et al.
2011/0155371 A1 6/2011 Panga et al.
2011/0198089 A1 8/2011 Panga et al.
2011/0247812 A1 10/2011 Panga et al.
2011/0312857 A1 12/2011 Amanullah et al.
2012/0000641 A1 1/2012 Panga et al.
2012/0000651 A1 1/2012 Panga et al.
2012/0132421 A1 5/2012 Loiseau et al.
2012/0138296 A1 6/2012 Panga et al.
2012/0190598 A1 7/2012 McCubbins, Jr. et al.
2012/0247764 A1 10/2012 Chen et al.
2012/0247767 A1 10/2012 Themig et al.
2012/0285694 A1 11/2012 Morvan et al.
2012/0305254 A1 12/2012 Chen et al.
2012/0318514 A1 12/2012 Mesher
2013/0206415 A1 * 8/2013 Sheesley ..... B65D 88/30 166/308.1
2013/0211807 A1 * 8/2013 Templeton-Barrett .. E21B 43/26 703/10
2013/0233542 A1 * 9/2013 Shampine ..... E21B 43/267 166/279
2014/0060831 A1 3/2014 Miller
2014/0096974 A1 * 4/2014 Coli ..... E21B 43/26 166/358
2014/0131045 A1 5/2014 Loiseau et al.
2014/0190691 A1 * 7/2014 Vinegar ..... B09C 1/02 166/272.1
2014/0216736 A1 * 8/2014 Leugemors ..... E21B 43/26 166/266
2014/0278315 A1 * 9/2014 Kim ..... E21B 43/00 703/10
2015/0066463 A1 * 3/2015 Shetty ..... E21B 41/00 703/10
2015/0377005 A1 * 12/2015 Garcia-Teijeiro ..... E21B 47/00 703/10

FOREIGN PATENT DOCUMENTS

CN 201358774 Y 12/2009
EP 1236701 9/2002

(56) References Cited

FOREIGN PATENT DOCUMENTS

| | | |
|---|---|---|
| EP | 2473705 | 7/2012 |
| GB | 2277543 | 11/1994 |
| RU | 2065442 | 8/1996 |
| RU | 2221130 | 1/2004 |
| RU | 2376451 | 12/2009 |
| RU | 2404359 | 11/2010 |
| RU | 2413064 | 2/2011 |
| RU | 2417243 | 4/2011 |
| WO | WO9607710 | 3/1996 |
| WO | WO9930249 | 6/1999 |
| WO | WO2004007904 | 1/2004 |
| WO | WO2004038176 | 5/2004 |
| WO | WO2006082359 | 8/2006 |
| WO | WO2009013710 | 1/2009 |
| WO | WO2009030020 | 3/2009 |
| WO | WO2009088317 | 7/2009 |
| WO | WO2009106796 | 9/2009 |
| WO | WO2009141749 | 11/2009 |
| WO | WO2010117547 | 10/2010 |
| WO | WO2011024100 | 3/2011 |
| WO | WO2011129937 | 10/2011 |
| WO | WO2011143055 | 11/2011 |
| WO | WO2012001574 | 1/2012 |

OTHER PUBLICATIONS

Kirk-Othmer Enclyclopedia of Chemical Technology, vol. 7, pp. 297-299 (1965).

SPE 131783—Less Sand May Not be Enough, M. Curry, T. Maloney, R. Woodroff, and R. Leonard, Feb. 23-25, 2010, SPR Unconventional Gas Conference, Pittsburg, PA, USA.

ARMA/USRMS 05-780—Experiments and numerical simulation of hydraulic fracturing in naturally fractured rock, C.J. De Pater and L.J.L. Beugelsdijk, Jun. 25-29, 2010, The 40th U.S. Symposium of Rock Mechanics (USRMS), Anchorage, AK, USA.

Nolte, K.G.: "Application of Fracture Design Based on Pressure Analysis," SPE13393—SPE Production Engineering, vol. 3, No. 1, 31-42, Feb. 1988.

Nolte, K.G. and Smith, M.B.: "Interpretation of Fracturing Pressures,"—SPE8297—JPT, vol. 12, No. 8, pp. 1767-1775, Sep. 1981.

Smith, M.B., Miller II, W.K., and Haga, J.: "Tip Screenout Fracturing: A Technique for Soft, Unstable Formations," SPE13273—SPE Production Engineering, vol. 2, No. 2, 95-103, May 1987.

Asgian, M.I., Cundall, P.A., and Brady, B.H. (1995) "Mechanical Stability of Porpped Hydraulic Fractures: A Numerical Study",—SPE28510—JPT, 203-208, Mar. 1995.

Milton-Tayler, D., Stephenson, C., and Asgian, M. (1992) "Factors Affecting the Stability of Proppant in Propped Fractures: Results of a Laboratory Study," paper SPE 24821 presented at the SPE Annual Technical Conference and Exhibition, Washington, DC, Oct. 4-7.

Desroches, J., et al. (1993) On the Modeling of Near Tip Processes in Hydraulic Fractures. International journal of rock mechanics and mining sciences & geomechanics abstracts, 30(7): p. 1127-1134.

Desroches, J., et al. (1994) The Crack Tip Region in Hydraulic Fracturing. Proc. R. Soc. Lond. A, 447: p. 39-48.

Schlumberger CemCRETE Brochure (2003).

Schlumberger Cementing Services and Products—Materials, pp. 39-76 (2012).

SPE 119366—Fracture Design Considerations in Horizontal Wells Drilled in Unconventional Gas Reservoirs; Cipolla, C.L., Lolon, E.P., Mayerhofer, M.J., and Warpinski, N.R. (2009).

Economides M.J. and Nolte K.G., Reservoir Stimulation, John Wiley and Sons, Ltd, 3rd Edition New York, 2000—Chapter 10, "Fracture Treatment Design" by Jack Elbel and Larry Britt, (pp. 10-1 to 10-50).

Economides M.J. and Nolte K.G., Reservoir Stimulation, John Wiley and Sons, Ltd, 3rd Edition New York, 2000—Chapter 8, "Performance of Fracturing Materials" by V.G Constien et al., (pp. 8-1 to 8-26).

Economides M.J. and Nolte K.G., Reservoir Stimulation, John Wiley and Sons, Ltd, 3rd Edition New York, 2000—Chapter 5, "Basics of Hydraulic Fracturing "by M.B.Smith and J.W. Shlyapobersky, (pp. 5-1 to 5-28).

Economides M.J. and Nolte K.G., Reservoir Stimulation, John Wiley and Sons, Ltd, 3rd Edition New York, 2000—Chapter 7, "Fracturing Fluid Chemistry and Proppants" by Janet Gulbis and Richard M.Hogde, (pp. 7-1 to 7-23).

Aveyard et al; "Emulsions stabilised solely by colloidal particles"; Advances in Colloid and Interface Science 100-102 pp. 503-546 (2003).

Binks et al; "Pickering emulsions stabilized by monodisperse latex particles: Effects of particle size"; Langmuir vol. 17 iss:15 p. 4540-4547 (2001).

Montagne etal; "Highly magnetic latexes from submicrometer oil in water ferrofluid emulsions"; Journal of polymer science. Part A, Polymer chemistry vol. 44 iss:8 p. 2642-2656 (2006).

Park et al; "Rheological Properties and Stabilization of Magnetorheological Fluids in a Water-in-Oil Emulsion"; Journal of Colloid and Interface Science 240, 349-354 (2001).

Pickering, Su; "Emulsions" Journal of the Chemical Society vol. 91pp. 2001-2021 (1907).

International Search Report and Written Opinion of International Application No. PCT/US2013/029833 dated Jun. 21, 2013, 13 pages total.

Office Action issued in Chinese Patent Application No. 201380024203.8 dated Apr. 22, 2016; 19 pages (with English translation).

Examination Report issued in GCC Patent Appl. No. GC 2013-23772 dated Aug. 8, 2016; 5 pages.

Office Action issued in Chinese Patent Appl. No. 201380024203.8 dated Mar. 28, 2017; 23 pages (with English translation).

* cited by examiner

SYSTEM AND METHOD FOR DELIVERING TREATMENT FLUID

BACKGROUND

The statements in this section merely provide background information related to the present disclosure and may not constitute prior art.

In the recovery of hydrocarbons from subterranean formations, it is often necessary to apply various treatment procedures to the well to improve the life and/or the productivity of the well. Examples of the treatment procedures include, but are not limited to, cementing, gravel packing, hydraulic fracturing, and acidizing. Particularly, in formations with low permeability, it is common to fracture the hydrocarbon-bearing formation to provide flow channels. These flow channels facilitate movement of the hydrocarbons to the wellbore so that the hydrocarbons may be recovered from the well.

Fracturing has historically been an operation where the materials that were going to be pumped were prepared on location. Deliveries of liquids, proppant, and chemicals were all accomplished before the job began. Specialized storage equipment was normally used for handling the large quantities of materials, such as sand chiefs made by Besser. Similarly, specialized tanks such as water tanks and frac tanks were used for liquids. These tanks are typically the largest possible volume that can be legally transported down the road without a permit. Once everything was ready, more specialized equipment was used to prepare gel, mix in proppant, dose with chemicals, and deliver the resulting fluid to the fracturing pumps under positive pressure. All of these specialized well site vehicles and units are expensive, and lead to a very large footprint on location.

FIG. 1A illustrates a wellsite configuration 9 that is typically used in current land-based fracturing operations. The proppant is contained in sand trailers 10 and 11. Water tanks 12, 13, 14, 15, 16, 17, 18, 19, 20, 21, 22, 23, 24, and 25 are arranged along one side of the operation site. Hopper 30 receives sand from the sand trailers 10,11 and distributes it into the mixers 26, 28. Blenders 33, 36 are provided to blend the carrier medium (such as brine, viscosified fluids, etc.) with the proppant and then transferred to manifolds 31, 32. The final mixed and blended slurry, or frac fluid, is then transferred to the pump trucks 27, 29, and routed at high pressure through treating lines 34 to rig 35, and then pumped downhole.

Referencing to FIG. 1B, a conventional fracturing operation 100 is illustrated schematically. The operation 100 includes a water tank 102 and a polymer supplier 104. The water tank is any base fluid including, for example, brine. The operation 100 may include a precision continuous mixer 106. In certain embodiments, the precision continuous mixer 106 is replaced by an operation 100 where the polymer is fully mixed and hydrated in the water tank 102. It can be seen that, where the polymer is pre-batched, very little flexibility to the size of the fracturing operation is available. For example, if an early screen-out occurs, a large amount of fracturing fluid is wasted and must be disposed. The operation 100 further includes an operation 108 to slowly agitate and hydrate the fracturing fluid, which may occur within a residence vessel or within a properly sized precision continuous mixer 106. The operation 100 further includes a proppant 110 mixed with the hydrated fluid, for example at a high-speed blender 112 that provides the proppant laden slurry to fracturing pumps. The operation 100 further includes an operation 114 to pump the slurry downhole.

It can be seen from the operation 100 that various equipment is required at the location, including the water tanks, a chemical truck or other vehicle carrying the polymer and/or other additives, a continuous mixer, a proppant vehicle (sand truck, sand chief, etc.), a blender (e.g. a POD blender), and various fracturing pumps. In some embodiments, the continuous mixer may be replaced with equipment and time to batch mix the fracturing fluid into the water tanks in advance, increasing the operational cost, reducing the flexibility of the fracturing treatment, and increasing the physical footprint of the fracturing operation. Also, a large amount of water is needed for a fracturing operation, which leads to the generation of a large amount of flowback fluid. The storage, management, and disposal of the flowback fluid are expensive and environmentally challenging.

Conventional logistical practices of a hydrocarbon bearing field (e.g. oilfield, natural gas field, etc.) vary over the life cycle of the field. After placement of the well, equipment delivery to the wellsite requires the construction of a road (often temporary), and delivery of various treatment fluids to the wellsite location. Treatment fluids are typically brought in by truck. After treatment of the well, produced fluids are brought to surface and must be brought into the commercial system through some delivery system. Initially some returned treatment fluids may need to be stored, recovered, or otherwise disposed. Produced fluids can be stored on-site and periodically picked up, brought to a collection facility near the wellsite, or be transferred into long range delivery systems such as pipelines. Some production fluid treatment and/or separation may be provided at the wellsite. During the life cycle of production of a well, periodic treatments may be indicated to increase production, remove well damage, or to treat for issues such as corrosion, paraffin buildup, water production, or other issues. Some zones within a wellbore may be shut in after producing for a time, and/or additional zones within the wellbore may be opened and/or stimulated, essentially requiring the types of treatment at the wellsite that more typically occur with newly drilled wells. After a formation has been produced for a period of time, one or more wells in the field may be converted or initially drilled to be injection wells, which may provide reservoir pressure support, flushing of fluids to producer wells, and/or fluid disposal.

As indicated by conventional logistical practices, a number of challenges are presented in the management of a well and a field over the life cycle of the field. Many conventionally managed fields suffer from one or more of the following challenges. Multiple types of fluid may be delivered to a wellsite over a number of years, which may require the building of temporary roads on multiple occasions or the maintenance of roads where land might otherwise be more productive. Production systems require long-range transport of excess fluids (e.g. water present in produced oil) and/or multiple units of separation or other production fluid treatment equipment. Injector wells require delivery of injection fluid to the well, and may require various types of fluid delivered to the wellsite over a number of years for various treatment operations. Wells and/or zones within wells may be converted from production to injection during the life cycle of the well. Additional zones opened within a well may require additional fluids delivered to the well, addition of separation or other production fluid treatment equipment to the wellsite, and/or a change in the type of separation or other production fluid treatment equipment as the produced fluids change over time or from distinct zones being produced.

The current application addresses one or more of the problems associated with conventional fracturing operations and/or conventional logistical practices of a hydrocarbon bearing formation.

SUMMARY

In certain embodiments, a system is disclosed which includes a regional blending facility having a number of bulk receiving facilities, where each bulk receiving facility receives and stores a particle type having a distinct size modality. The regional blending facility includes a bulk moving device that transfers particles between the bulk receiving facilities and a blending/continuously receiving vessel and/or a mixer, and a carrying medium vessel. The mixer receives particles from the blending/continuously receiving vessel and/or the bulk moving device, receives a carrying medium from the carrying medium vessel, mixes the particles with the carrying medium, and provides a mixed treatment fluid. The system further includes a fluid conduit that fluidly couples a wellsite location with the regional blending facility, where the fluid conduit is capable to deliver the mixed treatment fluid to the wellsite, and/or capable to deliver produced fluid from a wellbore positioned at the wellsite to the regional blending facility.

In certain embodiments, a system is disclosed which includes a regional blending facility having a number of bulk receiving facilities, where each bulk receiving facility receives and stores a particle type having a distinct size modality. The regional blending facility includes a bulk moving device that transfers particles between the bulk receiving facilities and a blending/continuously receiving vessel and/or a mixer, and a carrying medium vessel. The mixer receives particles from the blending/continuously receiving vessel and/or the bulk moving device, receives a carrying medium from the carrying medium vessel, mixes the particles with the carrying medium, and provides a mixed treatment fluid. The system further includes one or more local storage hub that receives the mixed treatment fluid from the regional blending facility and temporarily stores the mixed treatment fluid before usage. The system may further include a fluid conduit that fluidly couples a wellsite location with the local storage hub, where the fluid conduit is capable to deliver the mixed treatment fluid to the wellsite, and/or capable to deliver produced fluid from a wellbore positioned at the wellsite to the local storage hub. Similarly, the system may further include a fluid conduit that fluidly couples the regional blending facility with the local storage hub, where the fluid conduit is capable to deliver the mixed treatment fluid from the regional blending facility to the local storage hub, and/or capable to deliver produced fluid from a local storage hub to the regional blending facility.

In certain further embodiments, the system may include a supply facility that provides at least one bulk material to the bulk receiving facilities, where the supply facility is co-located with the regional blending facility. In some embodiments, the bulk material is a particulate and the supply facility may be a mine, a pit, a digging operation, and/or a quarry. In some embodiments, the bulk material is a liquid and the supply facility may be a pool, a lake, a pond, a sea, or other source of the liquid. The system may include a production fluid treatment facility that receives an amount of production fluid from the wellbore through the fluid conduit, where the production fluid treatment facility further performs an operation to separate the production fluid, to settle the production fluid, to store the production fluid, to transmit the production fluid. The system may include the production fluid treatment facility performing an operation to route at least a portion of the production fluid to a second fluid conduit that fluidly couples a second wellsite location with the regional blending facility, where the system further includes a second wellbore positioned at the second wellsite, and where the production fluid treatment facility is co-located with the regional blending facility.

In certain further embodiments, the system may include the regional blending facility further providing the mixed treatment fluid to the wellsite on a continuous basis and/or on a real-time basis, and may include the fluid conduit capable to selectively deliver both the mixed treatment fluid and the produced fluid at distinct times. An example system further includes the mixed treatment fluid being a high solids content fluid.

In certain further embodiments, the system may include further a production fluid treatment facility that receives an amount of production fluid from the wellbore through the fluid conduit, that separates the production fluid into a first production fluid portion and a second production fluid portion, that transmits the first production fluid portion, and that routes the second production fluid portion to a second fluid conduit that fluidly couples a second wellsite location with the regional blending facility. The system further includes a second wellbore positioned at the second wellsite, where the production fluid treatment facility is co-located with the regional blending facility. An example system further includes the regional blending facility further providing a well maintenance treatment fluid to one of the fluid conduit and the second fluid conduit, wherein the well maintenance treatment fluid includes a mixed treatment fluid, a matrix treatment fluid, a water control treatment fluid, a fluid diversion treatment fluid, a stimulation treatment fluid, a paraffin control treatment fluid, an asphaltene control treatment fluid, a gas lift fluid, and/or a particulate consolidation treatment fluid.

In certain embodiments, a system is disclosed including a regional blending facility including a subsystem for providing a mixed treatment fluid, where the regional blending facility fluidly is coupled to a plurality of wellsite locations. The system includes a controller having a treatment design module that interprets a treatment schedule having a fluid recipe and fluid preparation conditions; a facility control module that provides facility commands in response to the fluid recipe and fluid preparation conditions, where the subsystem for providing the mixed treatment fluid is responsive to the facility commands to provide the mixed treatment fluid to the wellsite on at least one of a continuous and a real-time basis.

In certain further embodiments, the system may include the mixed treatment fluid being a high solids content fluid (HSCF) having a number of particle size modalities, and may further include a supply facility that provides at least one particulate material to the bulk receiving facilities, where the supply facility is co-located with the regional blending facility, and where the at least one particulate material includes at least one of the number of particle size modalities.

In certain embodiments, a system includes a regional blending facility having a subsystem for providing a mixed treatment fluid, the regional blending facility fluidly coupled to a number of wellsite locations, and a subsystem for processing a production fluid amount. The system includes a controller having a treatment design module that interprets a treatment schedule including a fluid recipe and fluid preparation conditions, a facility control module that provides facility commands in response to the fluid recipe and fluid preparation conditions, and a production management module that interprets a production status corresponding to one of the wellsite locations and provides a facility production communication in response to the production status. The subsystem for providing the mixed treatment fluid is responsive to the facility commands, and the subsystem for processing the production fluid amount is responsive to the facility production command.

In certain further embodiments, the controller further includes a producer management module that interprets a producer treatment schedule and determines producer operations in response to the producer treatment schedule. The system further includes a subsystem for providing a producer treatment fluid in response to the producer treatment schedule, where the subsystem for providing the producer treatment fluid is responsive to the producer operations. The controller may further include an injector management module that interprets an injector treatment schedule and determines injector operations in response to the injector treatment schedule, where the system further includes a subsystem for providing an injector treatment fluid in response to the injector treatment schedule, and where the subsystem for providing the injector treatment fluid is responsive to the injector operations.

In certain further embodiments, the system includes each of the wellsites fluidly coupled to the regional blending facility with at least one fluid conduit, where each fluid conduit is capable to deliver the mixed treatment fluid to the wellsite, produced fluid from a wellbore positioned at the wellsite to the regional blending facility, and/or injection fluid to the wellsite. The system may include the facility production command being a separation command, where the injection fluid includes a separated portion of a produced fluid. The system may include a supply facility that provides at least one particulate material to the bulk receiving facilities, where the supply facility is co-located with the regional blending facility, and the controller includes a supply management module that interprets a supply status and the treatment schedule, a producer treatment schedule, and/or an injector treatment schedule, where the supply management module further provides a facility supply communication in response to the treatment schedule, a producer treatment schedule, and/or an injector treatment schedule, and where the supply facility is responsive to the facility supply communication.

In certain embodiments, a method includes interpreting a treatment schedule for a wellsite, providing a mixed treatment fluid at a regional blending facility in response to the treatment schedule, moving the mixed treatment fluid through a fluid conduit from the regional blending facility to the wellsite, producing a fluid from a wellbore at the wellsite, and moving the produced fluid through the fluid conduit from the wellsite to the regional blending facility. In certain further embodiments, the method may include separating the production fluid into a first production fluid portion and a second production fluid portion, transmitting the first production fluid portion, and routing the second production fluid portion to a second fluid conduit that fluidly couples a second wellsite location with the regional blending facility, and may further include injecting the second production fluid portion into a second wellbore positioned at the second wellsite. In certain further embodiments, the method may include co-locating the regional blend facility with a supply facility, where the providing the mixed treatment fluid further includes transferring at least one amount of particulates from the supply facility to the regional blending facility; providing the mixed treatment fluid by continuously providing the mixed treatment fluid during treatment operations at the wellsite; and/or providing the mixed treatment fluid by providing the mixed treatment fluid in real-time during treatment operations at the wellsite.

BRIEF DESCRIPTION OF THE DRAWINGS

These and other features and advantages will be better understood by reference to the following detailed description when considered in conjunction with the accompanying drawings.

DETAILED DESCRIPTION OF SOME ILLUSTRATIVE EMBODIMENTS

Figure 1A:
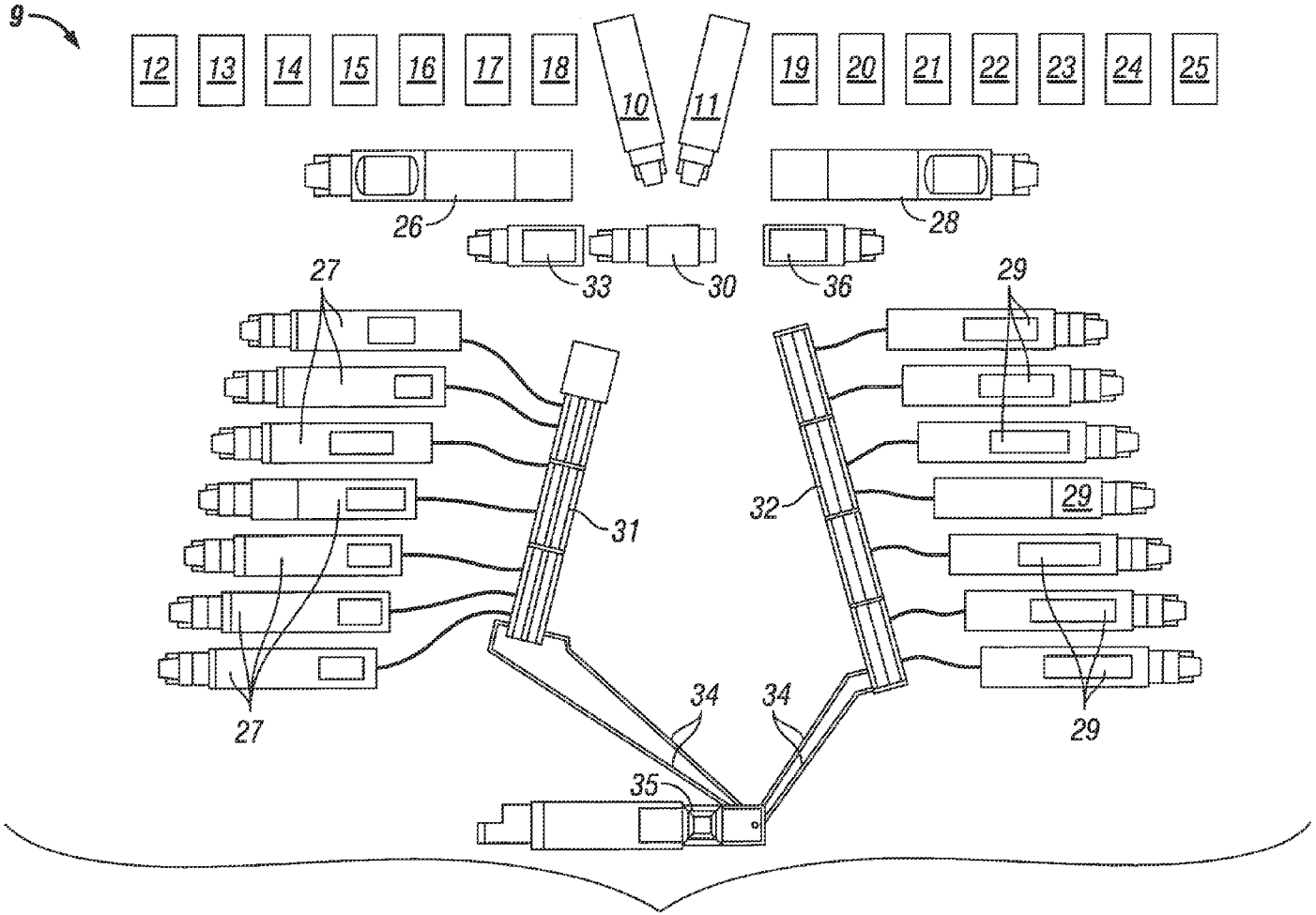
FIG. 1A (Prior Art)
FIG. 1A is a schematic representation of the equipment configuration of a conventional fracturing operation.
Figure 1B:
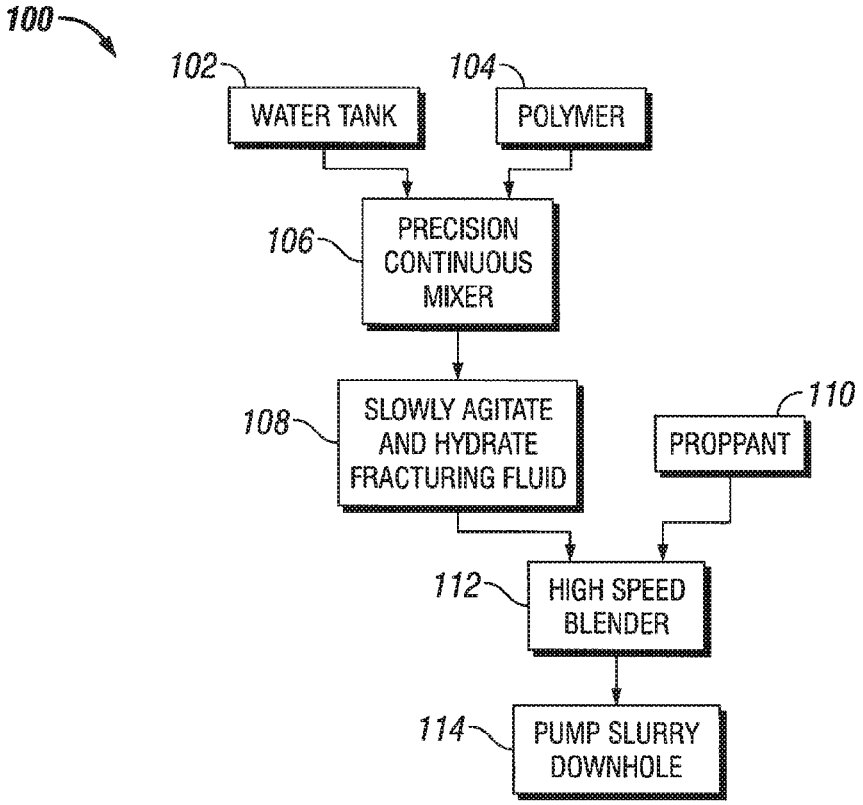
FIG. 1B (Prior Art)
FIG. 1B is a schematic representation of a conventional fracturing operation.

For the purposes of promoting an understanding of the principles of the disclosure, reference will now be made to the embodiments illustrated in the drawings and specific language will be used to describe the same. It will nevertheless be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

The schematic flow descriptions which follow provide illustrative embodiments of performing procedures for preparing and delivering treatment fluid or treatment fluid precursor to a wellsite. Operations illustrated are understood to be examples only, and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

In particular, it should be understood that, although a substantial portion of the following detailed description is provided in the context of oilfield hydraulic fracturing operations, other oilfield operations such as cementing, gravel packing, etc. can utilize and benefit from the disclosure of the current application as well. All variations that can be readily perceived by people skilled in the art after reviewing the current application should be considered as within the scope of the current application.

As used herein, the term "treatment fluid" should be understood broadly. Treatment fluids include liquid, a solid, a gas, and combinations thereof, as will be appreciated by those skilled in the art. A treatment fluid may take the form of a solution, an emulsion, a slurry, or any other form as will be appreciated by those skilled in the art. In some embodiments, the treatment fluid may contain a carrying medium and a substance that is substantially immiscible therein. The carrying medium may be any matter that is substantially continuous under a given condition. Examples of the carrying medium include, but are not limited to, water, hydrocarbon, gas, liquefied gas, etc. In some embodiments, the carrying medium may optionally include a viscosifying agent. Some non-limiting examples of the carrying medium include hydratable gels (e.g. guars, poly-saccharides, xanthan, diutan, hydroxy-ethyl-cellulose, etc.), a cross-linked hydratable gel, a viscosified acid (e.g. gel-based), an emulsified acid (e.g. oil outer phase or oil internal phase), an energized fluid (e.g. an $N_2$ or $CO_2$ based foam), a viscoelastic surfactant (VES) viscosified fluid, and an oil-based fluid including a gelled, foamed, or otherwise viscosified oil. Additionally, the carrier medium may be a brine, and/or may include a brine. The substantially immiscible substance can be any matter that only dissolves or otherwise becomes a constituent portion of the carrying fluid under a given condition for less than 10%, sometimes less than 20%, of the weight of substance when it is not in contact of the carrying medium. Examples of substantially immiscible substance include, but are not limited to, proppant, salt, emulsified hydrocarbon droplets, etc.

As used herein, the term "pump-ready" should be understood broadly. In certain embodiments, a pump-ready treatment fluid means the treatment fluid is fully prepared and can be pumped downhole without being further processed. In some other embodiments, the pump-ready treatment fluid means the fluid is substantially ready to be pumped downhole except that a further dilution may be needed before pumping or one or more minor additives need to be added before the fluid is pumped downhole. In such an event, the pump-ready treatment fluid may also be called a pump-ready treatment fluid precursor. In some further embodiments, the pump-ready treatment fluid may be a fluid that is substantially ready to be pumped downhole except that certain incidental procedures are applied to the treatment fluid before pumping, such as low-speed agitation, heating or cooling under exceptionally cold or hot climate, etc.

In certain embodiments, the pump-ready treatment fluid is a high particle content fluid where the volume fraction of the carrying medium in the pump-ready treatment fluid is less than 60% of the total volume of the pump-ready treatment fluid. Stated in another way, in such embodiments, the volume fraction of the immiscible substance in the pump-ready treatment fluid is equal to or more than 40% of the total volume of the pump-ready treatment fluid. In certain other embodiments, the volume fraction of the carrying medium is less than 50% of the pump-ready treatment fluid, with the immiscible substance making up 50% or more volume fraction of the pump-ready treatment fluid. In certain additional embodiments, the pump-ready treatment fluid has a volume fraction of the carrying medium that is less than 40% and a volume fraction of the immiscible substance that is 60% or more. In certain further embodiments, the pump-ready treatment fluid has a volume fraction of the carrying medium that is less than 30% and a volume fraction of the immiscible substance that is 70% or more. In certain even further embodiments, the pump-ready treatment fluid has a volume fraction of the carrying medium that is less than 20% and a volume fraction of the immiscible substance that is 80% or more. In certain additionally further embodiments, the pump-ready treatment fluid has a volume fraction of the carrying medium that is less than 10% and a volume fraction of the immiscible substance that is 90% or more.

In some cases, the immiscible substance contains a single particle size or particle size distribution (i.e. monomode). In some other cases, the immiscible substance contains a plurality of particles having distinct sizes or particles size distributions (i.e. multi-modes). As used herein, the terms distinct particle sizes, distinct particle size distribution, or multi-modes or multimodal, mean that each of the plurality of particles has a unique volume-averaged particle size distribution (PSD) mode. That is, statistically, the particle size distributions of different particles appear as distinct peaks (or "modes") in a continuous probability distribution function. For example, a mixture of two particles having normal distribution of particle sizes with similar variability is considered a bimodal particle mixture if their respective means differ by more than the sum of their respective standard deviations, and/or if their respective means differ by a statistically significant amount. In certain embodiments, the immiscible substance contains a bimodal mixture of two particles; in certain other embodiments, the immiscible substance contains a trimodal mixture of three particles; in certain additional embodiments, the immiscible substance contains a tetramodal mixture of four particles; in certain further embodiments, the immiscible substance contains a pentamodal mixture of five particles.

In some embodiments, the immiscible substance has a packed volume fraction (PVF) of 64% or higher. As used herein, the term "packed volume fraction, or PVF, means a theoretical calculation of the most likely configuration of particles of various sizes. It can be defined as the volume occupied by the particles divided by the total volume of the particles plus the void space between the particles. In certain other embodiments, the immiscible substance has a packed volume fraction (PVF) of 74% or higher. In certain additional embodiments, the immiscible substance has a packed volume fraction (PVF) of 87% or higher.

As used herein, the terms "particle" or "particulate" should be construed broadly. In certain embodiments, the particle or particulate is substantially spherical. In some certain embodiments, the particle or particulate is not substantially spherical. For example, the particle or particulate may have an aspect ratio, defined as the ratio of the longest dimension of the particle to the shortest dimension of the particle, of more than 2, 3, 4, 5 or 6. Examples of such non-spherical particles include, but are not limited to, fibers, flakes, discs, rods, stars, etc. Similarly, in some embodiments, the particle(s) or particulate(s) of the current application are solid such as proppant, sands, ceramics, crystals, salts, etc.; however, in some other embodiments, the particle(s) or particulate(s) can be liquid, gas, foams, emulsified droplets, etc. Moreover, in some embodiments, the particle(s) or particulate(s) of the current application are substantially stable and do not change shape or form over an extended period of time, temperature, or pressure; in some other embodiments, the particle(s) or particulate(s) of the current application are degradable, dissolvable, deformable, meltable, sublimeable, or otherwise capable of being changed in shape, state, or structure. All such variations should be considered within the scope of the current application.

Certain examples of treatment fluids, carrying media, and particles that can be used in the current application are illustrated in U.S. Pat. No. 7,784,541, US2011/0005760, US2010/0300688, U.S. Pat. No. 7,923,415, US2012/0000651, US2012/0000641, US2011/0155371, the entire contents of which are incorporated into the current application in the entireties.

In certain embodiments, the pump-ready treatment fluid is a fracturing fluid. In certain embodiments, the pump-ready fracturing fluid includes all ingredients, including proppant, for the fracturing treatment in a form that is directly deliverable to the suction side of a fracturing pump. The procedure may further include an operation to deliver the pump-ready fracturing fluid to a location operationally coupled to a wellsite, and an operation to provide the pump-ready fracturing fluid directly to a pump inlet. The procedure may further include an operation to pump the pump-ready fracturing fluid into a wellbore to initiate or propagate a fracture in the subterranean formation.

As used herein, the term "supply facility" should be understood broadly. A supply facility is any facility that provides one or more particles or particulate materials. A supply facility may include a mine, a pit, a quarry, a digging operation, and/or an interface to any of these. A supply facility may include only a portion of an overall facility including the mine or other operation to retrieve the particles or particulate materials, and may specifically include, but not be limited to, a transportation interface portion.

As used herein, the term "co-located" should be understood broadly. Co-located as used herein includes facilities that share the same building or other infrastructure, such as roads, parking areas, fences, areas covered within the same local area network (LAN), facilities referenced by the same location call sign or nickname, and/or facilities positioned together in any other operational sense. In certain embodiments, co-located facilities are facilities that are within walking distance of each other, facilities wherein materials travel between the facilities via equipment or other processes rather than vehicle transport, and/or facilities having the controls of relevant equipment of each facility being co-located in any other sense described herein. In certain embodiments, only relevant portions of each of the co-located facilities are positioned together as otherwise described herein.

As used herein, the term "production fluid treatment facility" should be understood broadly. A production fluid treatment facility includes any equipment that is utilized in the treatment, storage, or transmission of a produced fluid from a well. Example and non-limiting equipment included as a production fluid treatment facility includes a flare device, a settling tank, a separator of any kind, a holding tank, a reactor vessel, a distillation column, transmission lines, and/or valves, gauges, or detectors (e.g. pressure, temperature, flow, H2S detection, etc.). The production fluid treatment facility may be distributed or may be distinctly set off at the regional blending facility. One or more aspects of the production fluid treatment facility may be set off from the regional blending facility. In certain embodiments, a co-located production fluid treatment facility is recognized not by physical location with the regional blending facility, but additionally or alternatively by separation of the production fluid treatment facility equipment from a larger distribution system, which separation may be physical, schematic, notional, and/or operational. For example, a valve, gauge, or flow equipment beyond which is a larger distribution system for hydrocarbons may define the extent of the production fluid treatment facility. In certain embodiments, one or more aspects of the production fluid treatment facility may be included at each of a number of separate wellsites (e.g. a settling tank or flare), and one or more aspects of the production fluid treatment facility may be positioned at the regional blending facility.

As used herein, the term "well maintenance treatment fluid" should be understood broadly. A well maintenance treatment fluid is any treatment fluid or treatment fluid precursor utilized on a well at some point in time after the well has been utilized, or was otherwise deemed ready to be utilized, for an intended purpose. For example, any treatment occurring after a well has been placed into production, used as an injector, or was deemed to be ready for production or injection may utilize a well maintenance treatment fluid. Example and non-limiting well maintenance treatment fluids include a mixed treatment fluid (e.g. to re-stimulate the formation), a matrix treatment fluid, a water control treatment fluid, a fluid diversion treatment fluid, a stimulation treatment fluid, a paraffin and/or asphaltene control treatment fluids, a gas lift fluid, and/or a particulate consolidation treatment fluid.

Figure 2:
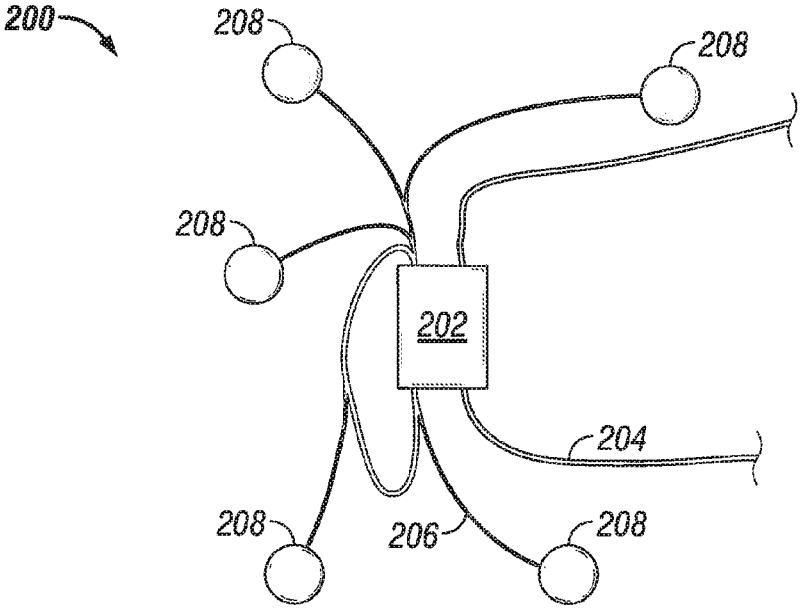
FIG. 2 is a schematic representation of a treatment fluid preparation system according to some embodiments of the current application.

Referencing now to FIG. 2, a regional blending facility 202 is depicted according to some embodiments of the current application. The facility 202 may include a loading access 204 and an off-loading access 206. The loading access 204 may be a road, a rail, canal, or any other transportation access wherein bulk product is deliverable to the facility 202. The off-loading access 206 may include any transportation access suitable for a transportation vehicle that accesses one or more wellsites 208 and delivers a treatment fluid and/or treatment fluid pre-cursor loaded at the facility 202 to the wellsites 208. The type of transportation access for each of the loading access 204 and off-loading access 206 should be understood broadly and may include any type of road access, rail access, barge or boat access, tracked vehicle access, pipelines, etc. In certain embodiments, the loading access 204 and off-loading access 206 include the same transportation access, and/or are located on the same side of the facility 202. The example facility 202 in FIG. 2 illustrates the loading access 204 and off-loading access 206 as separate transportation access separately and on opposite sides as one example, and to provide for clear illustration.

Example bulk material deliveries may include materials mined and processed on site (or nearby), trucked materials, or rail car materials. The loading and off-loading of mined or processed on site materials can be accomplished, in certain embodiments, using conventional techniques. Trucked and rail car delivered materials may be unloaded by using dumping or pneumatic conveying. Dumped materials may be collected and transferred into storage using screws, conveyor belts, air eductors, or valves into pressure pots for dense phase air transfer. In certain embodiments, equipment can be provided that either slides under the carrier or is built underground so that the carrier can move on top of the equipment. Pneumatic transfer is generally flexible in design and requires less site modification. Fine powders may be moved at relatively high transfer rates. The move of sand is related to the pressure rating of the delivering vehicle and the size and length of the delivery hoses. In certain embodiments, a receiving vessel is equipped with a vacuum system to lower the vessel pressure, which may increase the differential pressure between the carrier and the receiving vessel, allowing higher flow rates without increasing the rating of the carrier.

The facility 202 can be positioned at a distance from a group of wellsites 108, sometimes more than 250 miles away, sometimes more than 100 miles away, and sometimes more than 50 miles away. Such a regional facility 202 may enhance logistical delivery of bulk material to a plurality of wellsites. In some other embodiments, the facility 202 may be positioned in a field among wellsites as indicated. Other example facilities 202 may be positioned near a single wellsite—for example on or near a remote location such as an offshore platform, on or near a pad for access to multiple wells from a single surface location, etc., which will be discussed in more details below. Additionally or alternatively, an example facility 202 can be positioned incrementally closer to one or more wellsites 208 than a base facility (or facilities) for treating equipment utilized to treat wells at the wellsite(s) 208. Yet another example facility 202 is positioned to reduce a total trip distance of equipment utilized to treat a number of wellsites relative to treating the wellsites from the base facility (facilities) of the various treating equipment. Yet another example facility 202 is positioned to reduce a total trip distance of equipment utilized to treat a number of wellsites, where the wellsites are distributed in more than one continuous field of wellsite locations.

Bulk material as utilized herein includes any material utilized in large quantities in a treatment fluid for a formation in a wellbore. The amount of material to be a large quantity is context specific. An example large quantity includes any amount of a specific material that is a sufficient amount of the specific material to produce an amount of a treatment fluid that exceeds the transport capacity of a transportation vehicle that delivers treatment fluid to a wellsite 208. In one example, if a sand truck to deliver proppant to a wellsite holds 38,000 pounds of proppant, an amount of proppant exceeding 38,000 pounds is a large quantity. Example and non-limiting bulk materials include: proppant, particles for a treatment fluid, particles for a treatment fluid having a specified size modality, gelling agents, breaking agents, surfactants, treatment fluid additives, base fluid for a treatment fluid (e.g. water, diesel fuel, crude oil, etc.), materials utilized to create a base fluid for a treatment fluid (e.g. KCl, NaCl, KBr, etc.), and acids of any type.

Figure 3:
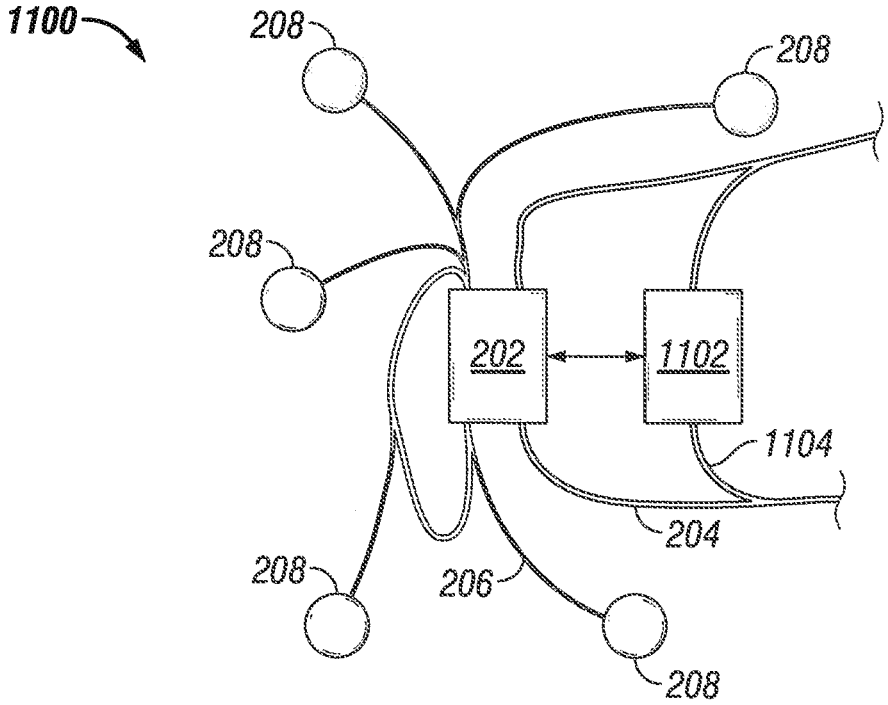
FIG. 3 is a schematic representation of a treatment fluid preparation system and a particulate supply facility according to some embodiments of the current application.

Referencing FIG. 3, a system 1100 includes a regional blending facility 202 is positioned in proximity to a hydrocarbon field having a number of wellsites 208. The arrangement of the regional blending facility 202 and the wellsites 208 is a non-limiting example. The system 1100 includes the regional blending facility 202 co-located with a supply facility 1102. In some embodiments, the supply facility 1102 supplies one or more bulk material. The supply facility 1102 in the example system 1100 has an independent external access 1104, such as a road, rail line, and/or canal, although in certain embodiments the regional blending facility 202 and the supply facility 1102 may share the same external access 1104, 204. The system 1100 depicts off-loading access 206 logistically coupling the regional blending facility 202 with the wellsites 208, although the system 1100 may additionally or alternatively include fluid conduits (not shown) or other connections between the regional blending facility 202 and the wellsites 208. The presence of the off-loading access 206 or other connections may be permanent, temporary, intermittent, and/or provided at the time they will be utilized.

Figure 4:
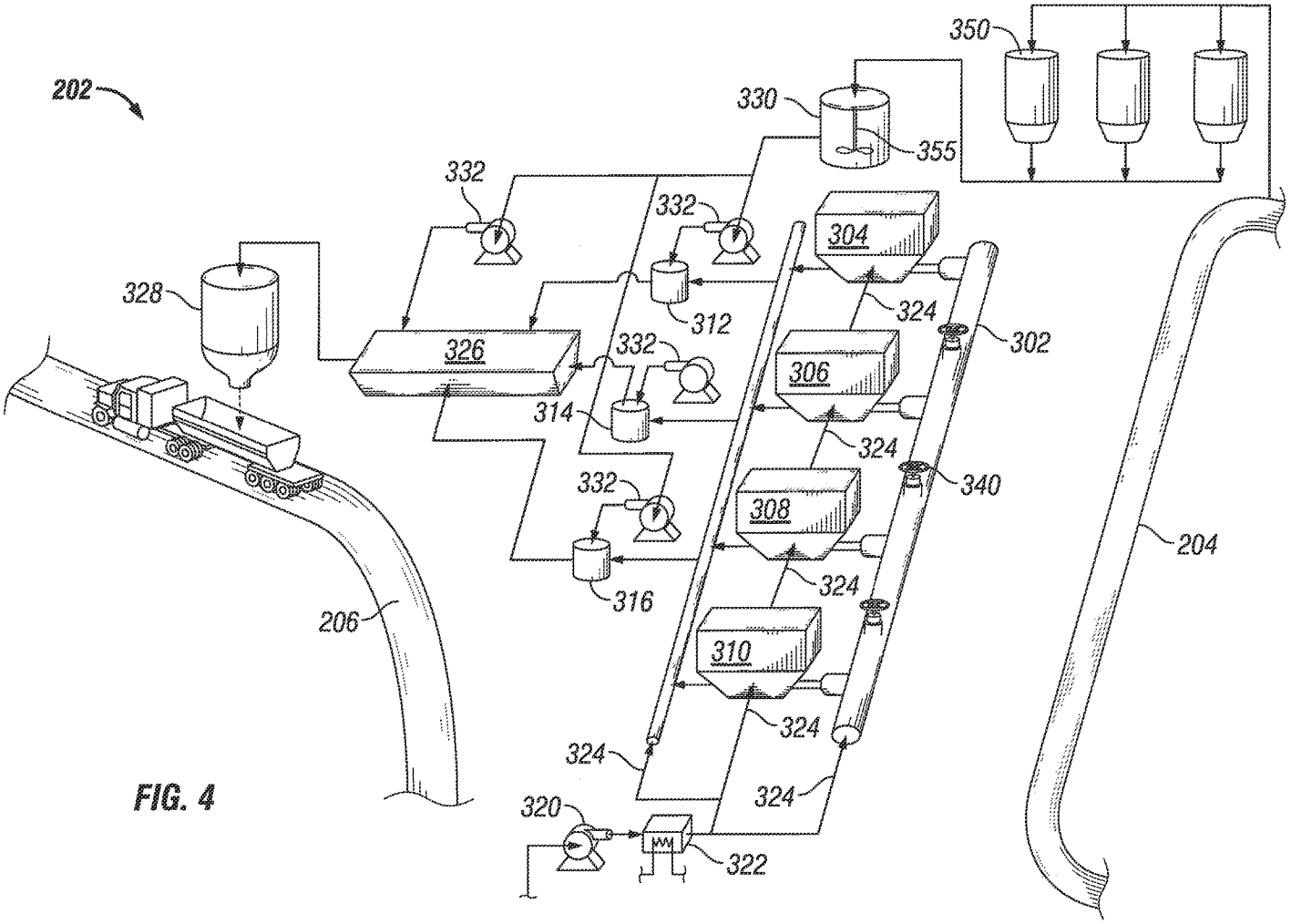
FIG. 4 is a schematic representation of a treatment fluid preparation facility according to some embodiments of the current application.

Referencing to FIG. 4, an example facility 202 is depicted schematically. The example facility 302 includes bulk receiving facilities 302 that receive and store a number of particle types. In one example, the bulk receiving facilities 302 receive bulk product from a delivering transport at the loading access 204, and deliver the bulk product to bulk storage vessels 304, 306, 308, 310. The example facility 202 includes the bulk receiving facilities 302 storing each of a distinct one of a number of particles size modalities into a corresponding vessel 304, 306, 308, 310. Distinct particle size modalities, as utilized herein, include particles having a distinct size value, which may be an average particle size, a particle size range, and/or a particle size maximum and/or minimum. Optionally, valves 340 are provided to control the flow of materials from the bulk receiving facilities 302 to one or more of the bulk storage vessels 304, 306, 308, 310.

In certain embodiments, the bulk receiving facilities 302 receive and deliver chemical or fluid additives to various storage areas of the facility 202. The bulk receiving facilities 302 may be a single device, a number of devices, and/or a number of distributed devices around the facility 202.

The bulk receiving facility 302 may further include a mobile receiver that is capable of being positioned under a bulk material carrier (not shown) that is positioned on the loading access 204. For example, a truck or rail car carrying particles may stop on the loading access 204 in proximity to the bulk receiving facility 302, and the bulk receiving facility 302 includes a receiving arm or funnel that can be rolled out, slid out, swiveled out, or otherwise positioned under the bulk material carrier. Any type of bulk material and receiving device that is positionable under the bulk material carrier is contemplated herein.

In some embodiments, the bulk receiving facility 302 may further include a below grade receiver that allows a bulk material carrier to be positioned thereabove. In one example, the loading access 204 includes a road having a hatch, covered hole, grate, or any other device allowing bulk material released from the bulk material carrier to pass therethrough and be received by the bulk receiving facility 302. The loading access 204, in certain embodiments, includes a raised portion to facilitate the bulk receiving facility 302 having a receiver below the grade of the loading access 204.

In certain embodiments, the bulk receiving facility 302 may include a pneumatic deliver system for pneumatically receiving bulk material. The illustrated facility 202 includes a pump 320 and pneumatic lines 324 structured in a single system connecting the bulk receiving facility 302 and the bulk storage vessels 304, 306, 308, 310. The configuration of the pneumatic delivery system may be any system understood in the art, including individual units for each vessel, grouped or sub-grouped units, etc. An example bulk receiving facility 302 is structured to de-pressurize during delivery from the bulk material carrier, and/or the pneumatic delivery system depressurizes the corresponding bulk storage vessel 304, 306, 308, 310 during delivery from the bulk material carrier. The facility 202 may include pneumatic equipment (not shown) to pressurize the bulk material carrier.

In certain embodiments, the bulk receiving facility 302 may include a receiving area (not shown) to receive and store a bulk material carrier in the entirety. For example, an example loading access 204 may include a rail, and the bulk receiving facility 302 may include a siding that allows a bulk material carrier to be received in the entirety and be utilized directly as one or more of the bulk storage vessels 304, 306, 308, 310 at the facility 202. The bulk receiving facility 302 may be structured to receive any type of bulk material carrier in the entirety to be utilized as one or more of the bulk storage vessels 304, 306, 308, 310. In certain embodiments, a portion of the bulk material carrier may be received directly to act as one or more of the bulk storage vessels 304, 306, 308, 310.

In some embodiments, the facility 202 may include one or more blending/continuously receiving vessels 312, 314, 316. The blending/continuously receiving vessels 312, 314, 316, where present, provide for intermediate components of a final product fluid to be prepared in the proper proportions. One or more particle types from the bulk storage vessels 304, 306, 308, 310 are delivered in the selected proportions to the blending/continuously receiving vessels 312, 314, 316. The bulk delivery may be pneumatic, for example through the pneumatic lines 324 and/or through a separate pneumatic system 324. In certain embodiments, the pneumatic system may include a heater 322 that heats the air in the pneumatic lines 324, especially with respect to bulk materials that are not sensitive to temperature variations, such as proppant. The heater 222 can be particularly beneficial for operations under freezing point, where the addition of bulk solids into carrying medium may cause the carrying medium to freeze.

In some embodiments, the delivery from the bulk storage vessels 304, 306, 308, 310 to the blending/continuously receiving vessels 312, 314, 316 includes a mechanical delivery device. For example, the bulk storage vessels 304, 306, 308, 310 may include a portion having a reduced cross-sectional area (e.g. cone bottomed vessels). A screw feeder or other mechanical device may also be used to transfer the bulk material from the bulk storage vessels 304, 306, 308, 310 to the blending/continuously receiving vessels 312, 314, 316. Each of the blending/continuously receiving vessels 312, 314, 316 can be coupleable to one or more of the bulk storage vessels 304, 306, 308, 310, for example by various valves (not shown). Conversely, each of the bulk storage vessels 304, 306, 308, 310 can be coupled to one or more of the blending/continuously receiving vessels 312, 314, 316, for example by various valves (not shown).

Dependent upon the types of treatment fluids produced, one or more of the blending/continuously receiving vessels 312, 314, 316 may be dedicated to or limited to delivery from one or more of the bulk storage vessels 304, 306, 308, 310. In one non-limiting example, a first blending/continuously receiving vessel 312 receives particles from the first bulk storage vessel 304, a second blending/continuously receiving vessel 314 receive particles from the second bulk storage vessel 306, and a third blending/continuously receiving vessel 316 selectively receives particles from the third and/or fourth bulk storage vessels 308, 310. In FIG. 4, the number of bulk storage vessels 304, 306, 308, 310 and blending/continuously receiving vessels 312, 314, 316 depicted is illustrative and non-limiting. The example arrangements described and depicted are provided as illustrations to depict the flexibility of the facility 202, but any arrangement of bulk storage vessels 304, 306, 308, 310 and blending/continuously receiving vessels 312, 314, 316 is contemplated herein.

In some embodiments, the facility 202 may further include a fluid vessel 330 and fluid pumps 332. Optionally, the fluid vessel 330 is connected with one or more fluid additive tanks 350. The fluid additives from the fluid additive tanks can be mixed in the fluid vessel 330 via, for example, a blending device 355. The fluid vessel 330 and fluid pumps 332 may contain any type of carrying medium, chemical(s), and/or additive(s) for a given treatment fluid. FIG. 4 shows only a single fluid vessel 330 and circuit that are coupled to various blending/continuously receiving vessels 312, 314, 316 and a mixing device 326 (see below), but it should be understood that any number of fluid vessels 330 and circuits may be present. Fluid additions to various vessels and streams in the facility 202 may be provided as desired and depending upon the fluid formulation of the product fluid.

In some embodiments, the facility 202 may further include a mixing device 326 that receives material from one or more of the blending/continuously receiving vessels 312, 314, 316 and provides a mixed product fluid to a product storage vessel 328. The mixing device 326 may be any mixing device understood in the art that is compatible with the components of the treating fluid and that provides sufficient mixing. Example and non-limiting mixing devices 326 include a feed screw and a feed screw having mixing feature that provides additional fluid motion beyond axial fluid motion along the feed screw. An example feed screw with a mixing feature may include a tab, a slot, and/or a hole in one or more threads of the feed screw. Other example and non-limiting mixing devices 326 include a drum mixer, a ribbon blender, a planetary mixer, a pug mill, a blender, a controlled solids ratio blender (e.g. a POD blender), and/or a colloidal mixer. Another example mixing device 326 is a twin shaft compulsory mixer.

The mixer 326, as well as related controls and/or connected hardware to the mixer 326, provides in certain embodiments for receiving batched products according to a mixing schedule. The mixing schedule may include a schedule in time, spatial, and/or sequential mixing descriptions. For example, and without limitation, the product provided from each of the blending/continuously receiving vessels 312, 314, 316 and/or fluid vessel 330 may be varied over time, the product provided from each of the blending/continuously receiving vessels 312, 314, 316 and/or fluid vessel 330 may be provided to the mixing device 326 at distinct spatial positions (e.g. as shown in FIG. 4), and/or the product provided from each of the blending/continuously receiving vessels 312, 314, 316 and/or the fluid vessel 330 may be provided according to a desired sequence.

In certain embodiments, the mixing device 326 and/or associated equipment conditions a powder (e.g. with an air pad, vibrator, heater, cooler, etc.) received at the mixing device 326. In certain embodiments, the mixing device 326 and/or associated equipment provides for a component dispersal. An example component dispersal includes pre-blending some or all of the component into one of the blending/continuously receiving vessels 312, 314, 316 (e.g. to provide hydration time), pre-blending with an educator system, utilizing a paddle blender, injection through a pump or orifice, and/or injection into a centrifugal pump eye. In certain embodiments, the mixing device 326 and/or associated equipment provides for fluid conditioning, for example providing a desired fluid shear trajectory (high, low, and/or scheduled), de-lumping, straining, colloidal mixing, and/or shaking the fluid. In certain embodiments, the mixing device 326 and/or associated equipment provides for particle conditioning, for example providing sufficient fluid shear to break a larger particle size into a smaller desired particle size, and/or providing sufficient fluid shear to break or prevent clumping (e.g. between silica and calcium carbonate).

In certain embodiments, the sequencing of the addition of materials from the blending/continuously receiving vessels 312, 314, 316, the spatial positions of the addition of materials, and/or the timing of the addition of materials, are selected to manage, minimize, or otherwise respond to compatibility issue and/or efficiency of mixing. For example, additions may be scheduled to minimize a contact time between incompatible components, and/or to add a material that minimizes incompatibility effects between two materials before one or both of the materials are added. In certain embodiments, the sequencing of the addition of materials from the blending/continuously receiving vessels 312, 314, 316, the spatial positions of the addition of materials, and/or the timing of the addition of materials, are selected to account for physical deliverability characteristics of the components to be mixed. For example, a largest component may be added at a slow feed rate to the mixing device 326 at a position sweeping the entire device. A non-limiting example includes adding a largest component, adding all of a smallest component during the addition of the largest component, adding a medium component, and then finishing with the remainder of the largest component. A still further non-limiting example includes sequentially adding larger components and finishing with the addition of the largest component.

In certain embodiments, the mixing device 326 delivers the mixed product to a storage vessel 328. In certain embodiments, the mixing device 326 delivers the mixed product fluid directly to a transportation vehicle (not shown) which then transports the mixed product to a wellsite 208. In one example, the product storage vessel 328 is positioned to gravity feed a transportation vehicle. In some other examples, the product storage vessel 328 is positioned direction above the off-loading access 206, which in turn feeds a transportation vehicle. In certain embodiments, the product storage vessel 328 is pressurizable. In certain embodiments, the product storage vessel 328 includes a circulating pump, agitator, bubble column pump, and/or other agitating or stirring device.

Figure 5:
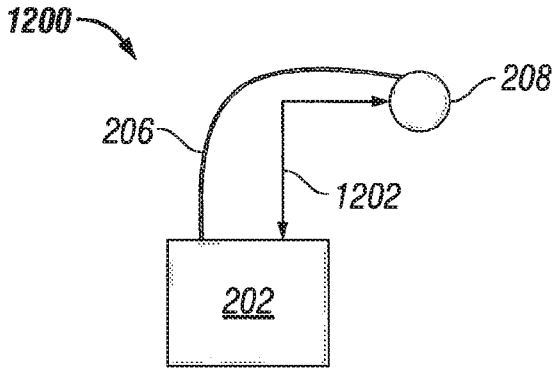
FIG. 5 is a schematic representation of a treatment fluid preparation facility and a fluid line coupling the treatment fluid preparation facility to a wellsite.

Referencing FIG. 5, a system 1200 includes a regional blending facility 202. The system 1200 further includes a fluid conduit 1202 that fluidly couples a wellsite location 208 with the regional blending facility 202. The fluid conduit 1202 is capable to deliver the mixed treatment fluid to the wellsite 208, and/or capable to deliver produced fluid from a wellbore positioned at the wellsite 208 to the regional blending facility 202. For example and without limitation, the fluid conduit 1202 includes a size, material, and pressure rating capable to perform the operations of delivering mixed treatment fluid to the wellsite 208, and/or to deliver produced fluids from the wellsite 208 to the regional blending facility 202. The fluid compositions, pressures, temperatures, flow rates, and other characteristics of the fluids utilized will vary with the characteristics of the formation, job designs, and other considerations that are generally known to one of skill in the art contemplating a particular wellsite 208, wellbore, and target formations. The flow rates of the fluid flowing to the wellsite 208 may be sufficient to support an ongoing real-time operation such as a fracture treatment, and/or the wellsite 208 location may include storage tanks or other features to allow for the treatment fluid to be transported to the wellsite 208 before and/or during the treatment operations.

The fluids flowing to the wellsite 208 may be acids, energized fluids, fluids having particulates, HSCF, fluids based upon produced formation fluids (e.g. a gelled oil treatment), or any other type of fluid known in the art. The fluids flowing from the wellsite 208 back to the regional blending facility 202 may be "sour" fluids, gases, liquids, and may further include any of the treatment fluids such as during a flowback operation after a treatment. In certain embodiments, the fluid conduit 1202 may include separated conduits for the fluid flow in each direction, although the same conduits may be utilized for flow in each direction.

In certain embodiments, the mixed treatment fluid, or any other treatment fluid including fluids that do not have particulates but that are generated at the regional blending facility 202 or a local storage hub, is provided on a continuous basis and/or during real-time during a treatment. Provision of fluid on a continuous basis includes, in certain embodiments, the mixer 326 accepting fluid, additives, and/or particles on a continuous basis in the appropriate ratios to provide a continuous stream of treatment fluid during the treatment operations. In certain embodiments, a continuous stream of treatment fluids are provided to the fluid conduit 1202 to the wellsite 208 before treatment operations, for example to fill a vessel or storage tank. In continuous operation, the blending/continuously receiving vessels 312, 314, 316 may be present or not, and the storage vessel 328 may be present or not. Provision of fluid on a real-time basis includes providing fluid during the treatment operations, where the provided fluid is utilized as it is provided or within a short time of being provided. Provision of fluid on a real-time basis can include storage tanks utilized in the system, for example to allow for variability in the treatment flow rate and/or to allow for the regional blending facility 202 to continue to be operated in a batch mode during the real-time provision. The regional blending facility may be operated in either or both of a continuous basis and a real-time basis during a given treatment operation.

Figure 6:
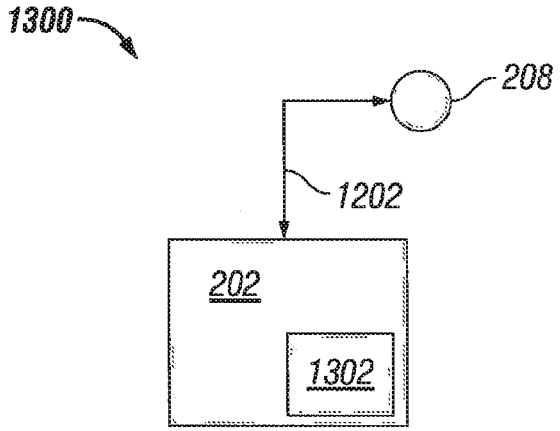
FIG. 6 is a schematic representation of a treatment fluid preparation facility having a production fluid management facility, and a fluid line coupling the treatment fluid preparation facility to a wellsite.
Figure 7:
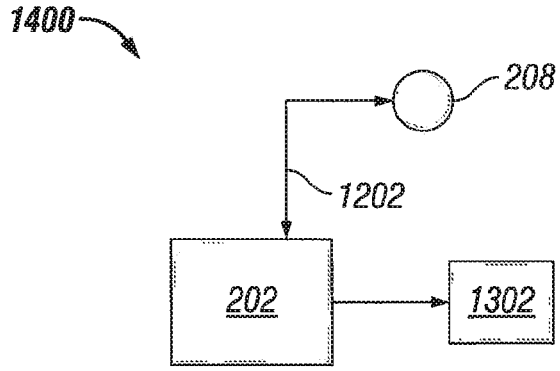
FIG. 7 is a schematic representation of a treatment fluid preparation facility coupled to a production fluid management facility, and a fluid line coupling the treatment fluid preparation facility to a wellsite.

Referencing FIG. 6, a system 1300 includes a production fluid treatment facility 1302 that receives an amount of production fluid from the wellbore through the fluid conduit 1202. The production fluid treatment facility 1302 further performs an operation to separate the production fluid, to settle the production fluid, to store the production fluid, and/or to transmit the production fluid away from the regional blending facility 202. Referencing FIG. 7, a system 1400 includes the production facility 1302 operationally coupled to, and/or co-located with but positioned in a distinct physical location from, the regional blending facility 202.

Figure 8:
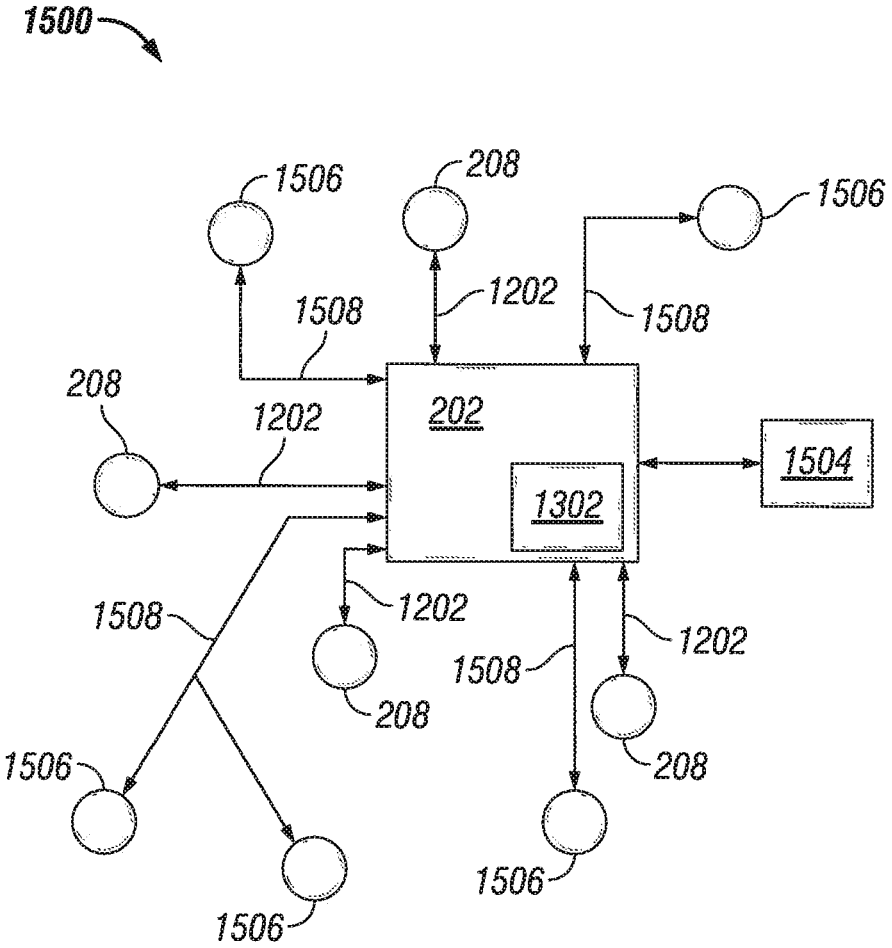
FIG. 8 is a schematic representation of a treatment fluid preparation facility having an injection fluid management system, coupled to an auxiliary facility, and fluid lines coupling the treatment fluid preparation facility to a number of different well types.

Referencing FIG. 8, a system 1500 includes a production fluid treatment facility 1302 that performs an operation to route at least a portion of the production fluid to a second fluid conduit 1508 that fluidly couples a second wellsite 1506 location with the regional blending facility 202. The system 1500 includes a second wellbore positioned at the second wellsite 1506, and where the production fluid treatment facility 1302 is co-located with the regional blending facility 202. Although a plurality of wellsites 208 and second wellsites 1506 are schematically illustrated in FIG. 8, it should be noted that any number of wellsites 208 and/or second wellsites 1506 can be present in system 1500. In some embodiments, more wellsites 208 than second wellsites 1506 are present in system 1500; in some embodiments more second wellsites 1506 than wellsites 208 are present in system 1500; in some embodiments, approximately equal number of wellsites 208 and second wellsites 1506 are present in system 1500.

In certain embodiments, the production fluid treatment facility 1302 receives an amount of production fluid from the wellbore through the fluid conduit 1202, separates the production fluid into a first production fluid portion and a second production fluid portion, that transmits the first production fluid portion (e.g. to an external facility 1504), and routes the second production fluid portion to a second fluid conduit 1508 that fluidly couples a second wellsite location 1506 with the regional blending facility 202. The system 1500 further includes a second wellbore positioned at the second wellsite 1506, where the production fluid treatment facility 1302 is co-located with the regional blending facility 202. An example system 1500 further includes the regional blending facility 202 further providing a well maintenance treatment fluid to one of the fluid conduit 1202 and the second fluid conduit 1508, wherein the well maintenance treatment fluid includes a mixed treatment fluid, a matrix treatment fluid, a water control treatment fluid, a fluid diversion treatment fluid, a stimulation treatment fluid, a paraffin control treatment fluid, an asphaltene control treatment fluid, a gas lift fluid, and/or a particulate consolidation treatment fluid. An example system 1500 includes wellsites 208 corresponding to production wells, and wellsites 1506 corresponding to injection wells. The first production fluid portion may be hydrocarbons or other commercial products of the produced fluids, and the second production fluid portion may be remainder fluids such as water. The second production fluid portion may be combined with other injection fluids before sending to the second fluid conduit 1508.

Figure 9:
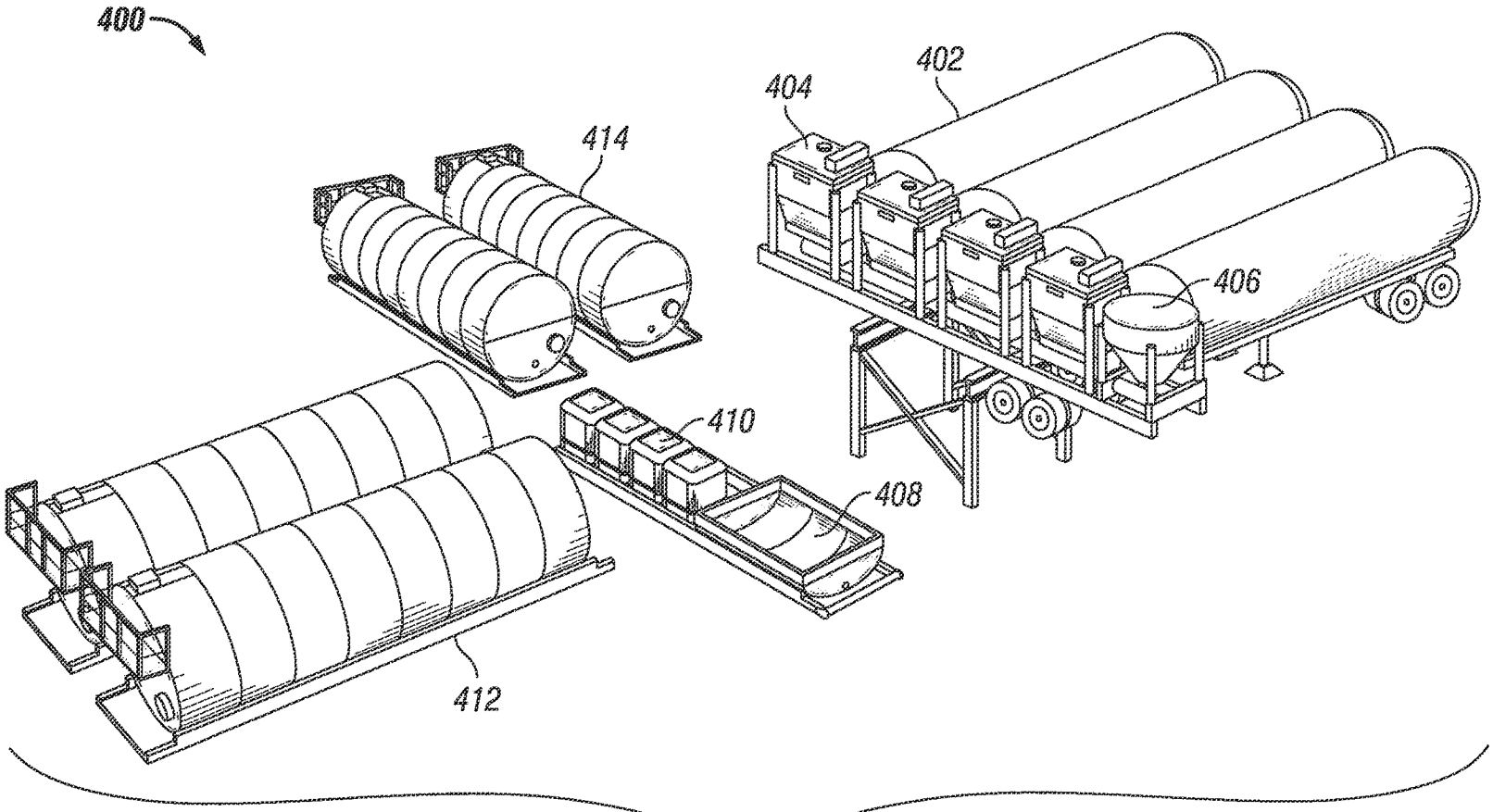
FIG. 9 is a schematic representation of a blending plant for preparing treatment fluids according to some embodiments of the current application.

Referencing to FIG. 9, an example blending plant 400 is illustrated. The blending plant 400 may include a number of bulk storage vessels 402. Example storage of bulk materials includes cone bottom vessels that may be readily emptied through the bottom. In some instances augers may be used to pull material from the bottom of the storage vessel and move it to the mixing area. In some cases, a plant uses tanks that can be pressurized and pneumatically convey the material, which allows more flexible location of the bulk storage and makes combining storage units more feasible. In some cases, an storage system may include equipment provided to pressurize and convey the product with heated and/or dried air. This allows the product to be raised above the freezing point, avoiding the product freezing in the mixing system when water is added. In some cases, the blending plant 400 may include an area where the bulk delivery carriers (e.g. rail cars) may be parked after delivering bulk materials to the plant. In such an event, the carriers themselves can be used as the storage for the plant, rather than having separate storage vessels.

The blending plant 400 may further include a number of blending/continuously receiving vessels 404. Each blending/continuously receiving vessel 404 may be operationally coupled to a load cell (not shown), so that the blending/continuously receiving vessel 404 may provide prescribed amounts of each particle from the bulk storage vessels 402. Examples of batch measurement of bulk materials include accumulative and/or decumulative weigh batching, which involves the use of a storage device (or batcher) mounted on load cells where the amount of powder can be determined by weighing the batcher. Accumulative methods measure the accumulation of powder delivered to the batcher. Once the appropriate amount is the batcher, delivery is stopped and the powder may be supplied to the mixing system. Decumulative batching uses a large storage vessel where the movement of powder out of the vessel is measured. An example batch measurement system includes a batcher that is slightly larger than needed, where the batcher is filled by weight to slightly more than needed. Then, powder is extracted and a more precise measurement is made by decumulation.

Alternatively or additionally, batch measurement is achieved by direct control of the moving product. In certain embodiments, calibrated feeders (such as screw, belt, airlock, starwheel, or vibratory feeders) are used. In certain other embodiments, flow measuring devices (such as flow meters, mass flow meters, impact particle flow meters, etc.) are used.

A fluid vessel 406 may be provided along the blending/continuously receiving vessels 404. The blending/continuously receiving vessels 404 and the fluid vessel 406 can be loaded on a raised trailer, as illustrated in FIG. 9, which can provide convenient loading or passing to a mixer (not shown) positioned underneath the raised trailer. The blending/continuously receiving vessels 404 may provide particles to the mixer through a screw feeder or other feeding device, as can be understood by people skilled in the art.

The blending plant 400 may further include a number of carrying medium vessels 414. The carrying medium vessels 414 may contain water, brine, as well as any other suitable carrying medium. Different carrying medium vessels 414 may contain the same type of liquid or distinct types of liquid. The blending plant 400 further includes a number of additive vessels 410. The additive vessels 410 may contain chemicals, gelling agents, acids, inhibitors, breakers, or any other type of additive to be combined with the carrying medium. The skid including the additive vessels 410 may further include a batching tub 408. The final mixed product can be stored in finished product storage 412.

The units at the example blending plant 400 are shown as skid loaded and transportable by standard highway vehicles. In certain embodiments, the entire bulk facility 202 can be made from skid loaded and/or transportable units. In certain embodiments, a portion or the whole bulk facility 202 are permanently constructed at a location.

The use of a centralized facility 202 and/or a blending plant 400 provides for enhanced quality assurance and quality control of treatment fluids use at the wellsite. The facility 202 ensures that fluids are being generated in a uniform fashion and with uniform source materials (e.g. the same water source). Additionally, the mixing and material delivery equipment is not being moved or adjusted, and individual pieces of equipment are not being changed out—avoiding, for example, part to part variability that occurs when different slurry or proppant blenders (such as POD blenders) are present on separate locations due to equipment availability. Further, the mixing and material delivery equipment at the facility 202 is not constrained to the same mobility requirements that apply to wellsite mixing and material delivery equipment, allowing for higher equipment quality and precision. In certain embodiments, a crew or crews working the facility 202 or blending plant 400 may also have a more stable composition over time, for example relative to the composition of hydraulic fracturing crews, so that variability due to personnel is also minimized.

Still further, the centralized location of the fluid product provides one geographic location for testing one or more fluid features with precision. For example, a single unit of expensive testing equipment can thereby test all relevant treatment fluids for the region serviced by the facility 202 or blending plant 400. Additionally, any complex or time consuming testing procedures can be performed at the facility 202 or blending plant 400, avoiding travel costs and risks for testing personnel to be available at individual wellsite locations. In certain further embodiments, the automation and control elements available due to the presence of a controller 1002 (see the description referencing FIG. 15) provide for improved treatment fluid uniformity, quality assurance (e.g. feedforward fluid quality management), and quality control (e.g. feedback fluid quality management) over treatment fluids that are individually batched or generated in real-time for each treatment at wellsite locations.

An example centralized facility 202 and/or a blending plant 400 provides an improved system-wide environmental impact by decoupling the wellsite location from the facility 202 location. For example, the facility 202 and/or blending plant 400 can be provided in an area that is not environmentally sensitive (e.g. an industrially zoned area), avoiding areas that are environmentally sensitive. Example and non-limiting environmental sensitivities include zoning constraints, noise considerations, the presence of endangered species, wetlands, and/or amicability considerations. Additionally or alternatively, the facility 202 and/or blending plant 400 can be provided in an area that enables environmental management, such as carbon capture, fluid disposal, and/or fluid treatment that is not equivalently available at an individual wellsite.

In certain additional or alternative embodiments, the use of a centralized facility 202 and/or a blending plant 400 provides for an improved environmental impact of the treatment fluid generation system. In one example, the facility 202 can be co-located with treatment facilities and/or disposal facilities. As an example, carbon capture facilities (e.g. a disposal well) may be present to store carbon dioxide emissions from various powered equipment at the facility 202. Any chemical or fluid effluents from the facility 202 can be treated into neutral products and/or stored in a disposal facility (e.g. a separate disposal well, the same disposal well, and/or a separate geological zone within the disposal well). Additionally, the facility 202 and related equipment is not constrained to be highly mobile, and accordingly enhanced environmental equipment (e.g. dust catchers, sound mufflers, etc.) may be present that would be inconvenient or expensive to include on wellsite mobile equipment.

Figure 10:
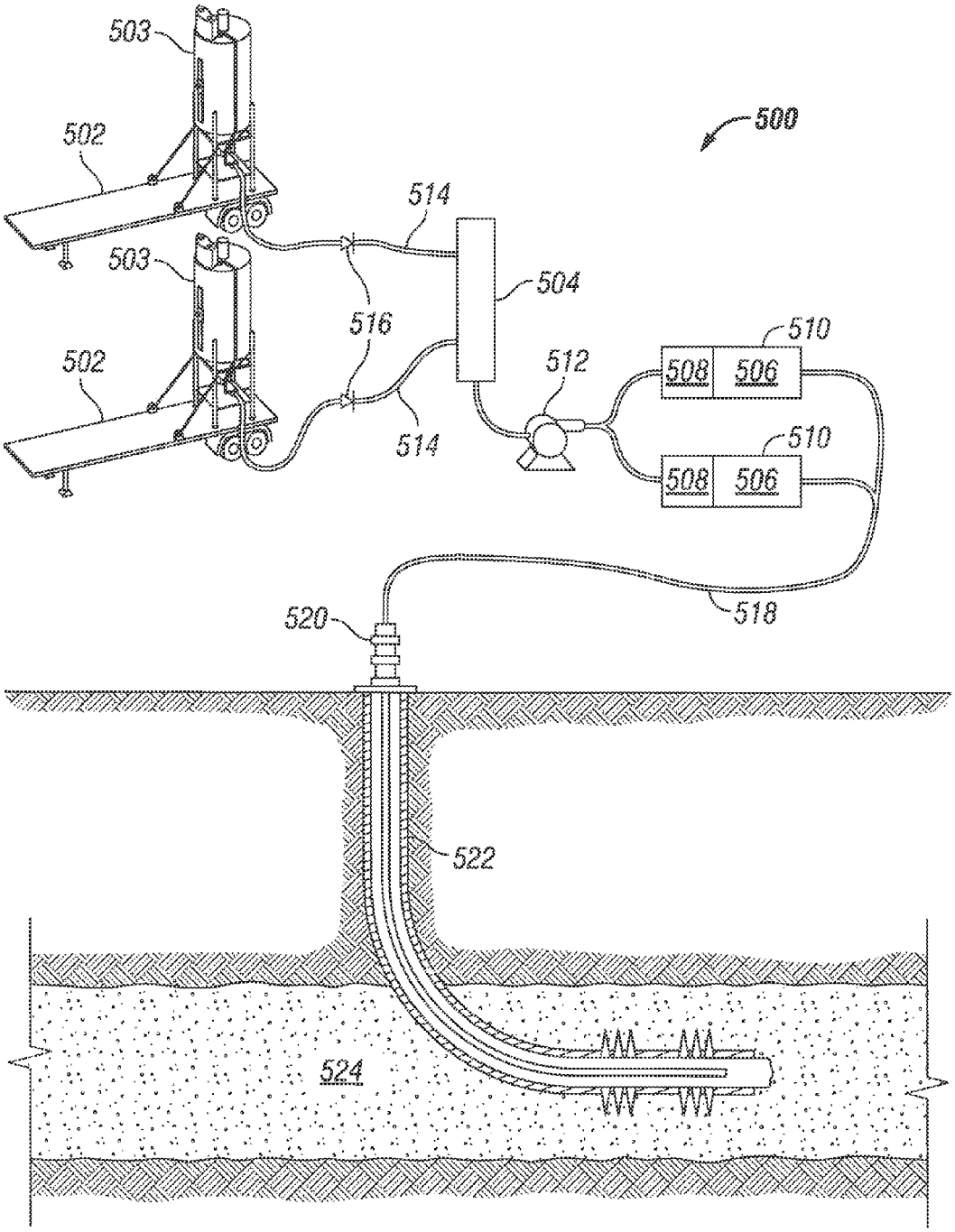
FIG. 10 is a schematic representation of the use of the treatment fluid at a wellsite according to some embodiments of the current application.

Referencing to FIG. 10, an exemplary system 500 for treating a formation 524 fluidly coupled to a wellbore 522 via a wellhead 520 is shown. A portion or the entire setup of system 500 may be present at wellsite 208, 1506, 804, 804', or 904, although people skilled in the art with the benefit of the current disclosure may devise different setup from the one illustrated in FIG. 10 and described herein. In this exemplary system 500, one or more wellsite transportation vehicles 502 may be included. The system 500 may further include one or more vessels 503 for providing mixed product fluid to a low pressure manifold 504. The low pressure manifold 504 may be fluidly coupled to the suction side 508 of fracturing pumps 510. The fracturing pumps 510 may include a high pressure side 506 fluidly coupled through a high pressure line 518 to a wellhead 520. The system 500 may further include a circulation pump 512 such as a centrifugal pump on the low pressure side to facilitate the flow of the low pressure fluid from the low pressure manifold 504 to the fracturing pumps 510.

The system 500 may further include one or more check valves 516 positioned between the low pressure manifold 504 and the vessels on the wellsite transportation vehicles 502. Additional or alternative, the system 500 may be a system that includes a means for adding a gel pill (e.g. a gel pill fluid source and pressurizing pump), a system without a low pressure manifold 504, a system with one or more fracturing pumps dedicated to particle free solution delivery (which may be coupled to a high pressure manifold), and/or a system with a fluid tank and fluid tank delivery pressure mechanism (e.g. sufficient hydraulic pressure from the orientation and/or raising of the fluid tank, pressurizing pump for the fluid tank, etc.).

The wellbore 522 may be cased and/or cemented into the ground. Alternatively or additionally, the wellbore 522 may be open or otherwise unfinished or uncompleted. The wellbore 522 may be a vertical well or a horizontal well, as shown in FIG. 10. The formation 524 may be an oil formation, a shale gas formation, a source rock, or a formation bearing any other type of hydrocarbon or natural resource that is interested to the operator.

An example procedure that can be implemented by system 500 may include performing the fracture treatment where no blender is present at the location. An example procedure may further include an operation to recirculate a sump of the positive displacement pump during the pumping. The operation to recirculate the sump and/or suction side of the positive displacement pump includes operating a recirculating pump fluidly coupled to the sump/suction side of the fracturing pump.

Figure 11:
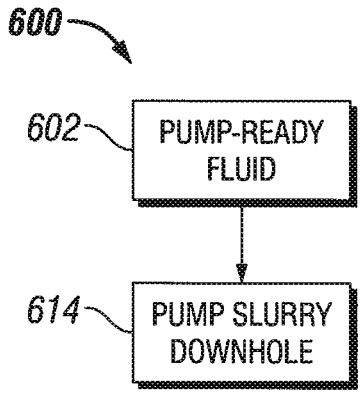
FIG. 11 is a schematic representation of a treatment fluid preparation system according to some embodiments of the current application.

Referencing FIG. 11, an example operation 600 includes a pump-ready fluid 602 that is prepared at a facility 202 and transported to the wellsite via a transportation vehicle 502. The pump-ready fluid 602 can then be pumped downhole in operation 614. Accordingly, in certain embodiments, a fracturing operation is performed without a proppant vehicle (sand truck, sand chief, etc.) and/or a blender (e.g. a POD blender) present on the location. In certain embodiments, the fracturing operation is performed without a continuous mixer provided on the location. In certain embodiments, the fracturing operation is performed without a continuous mixer and without pre-batching fracturing fluid into tanks provided on the location, including large water tanks (e.g. 400 BBL tanks). The footprint needed at the wellsite for a fracturing operation can be significantly reduced.

Figure 12:
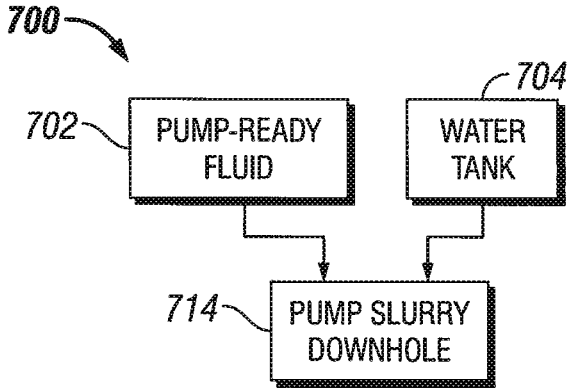
FIG. 12 is another schematic representation of a treatment fluid preparation system according to some embodiments of the current application.

FIG. 12 illustrates a fracturing operation 700 which, in addition to the embodiment represented in FIG. 11, further includes one or more water tanks 704. In certain embodiments, the water tanks 704 can be used to provide flush and/or displacement fluids. Additionally or alternatively, the water tanks 704 can be used to provide dilution water to bring a super-concentrated pump-ready fluid 702 down to a designed particle content and/or density before the operation 714 to pump the slurry downhole. The pump-ready fluid 702 and/or water tanks 704 are provided, in certain embodiments, with sufficient inherent pressure (e.g. through elevation, fluid depth, head tanks, etc.) that a blender or other pressurizing equipment is not required to feed the pump-ready fluid 702 and/or water from the water tanks 704 to the fracturing pumps. Moreover, in certain embodiments, a fracturing operation is performed without a proppant vehicle (sand truck, sand chief, etc.) and/or a blender (e.g. a POD blender) present on the location. In certain embodiments, the fracturing operation is performed without a continuous mixer provided on the location. Therefore, the footprint needed at the wellsite for a fracturing operation can still be significantly reduced.

An example procedure, which may be performed in the context of any of the systems described herein, includes an operation to interpret a treatment schedule for a wellsite and an operation to provide a mixed treatment fluid at a regional blending facility in response to the treatment schedule. The procedure includes an operation to move the mixed treatment fluid through a fluid conduit from the regional blending facility to the wellsite, an operation to produce a fluid from a wellbore at the wellsite, and an operation to move the produced fluid through the fluid conduit from the wellsite to the regional blending facility. In certain further embodiments, a procedure further includes an operation to separate the production fluid into a first production fluid portion and a second production fluid portion, an operation to transmit the first production fluid portion (e.g. to an external distribution system), and an operation to route the second production fluid portion to a second fluid conduit that fluidly couples a second wellsite location with the regional blending facility. An example procedure further includes an operation to inject the second production fluid portion into a second wellbore positioned at the second wellsite. In certain further embodiments, an example procedure includes an operation to co-locate the regional blending facility with a supply facility, where the operation to provide the mixed treatment fluid further includes an operation to transfer at least one amount of particulates from the supply facility to the regional blending facility. In certain embodiments, the example procedure further includes an operation to provide the mixed treatment fluid by continuously providing the mixed treatment fluid during treatment operations at the wellsite, and/or an operation to provide the mixed treatment fluid by providing the mixed treatment fluid in real-time during treatment operations at the wellsite.

Figure 13A:
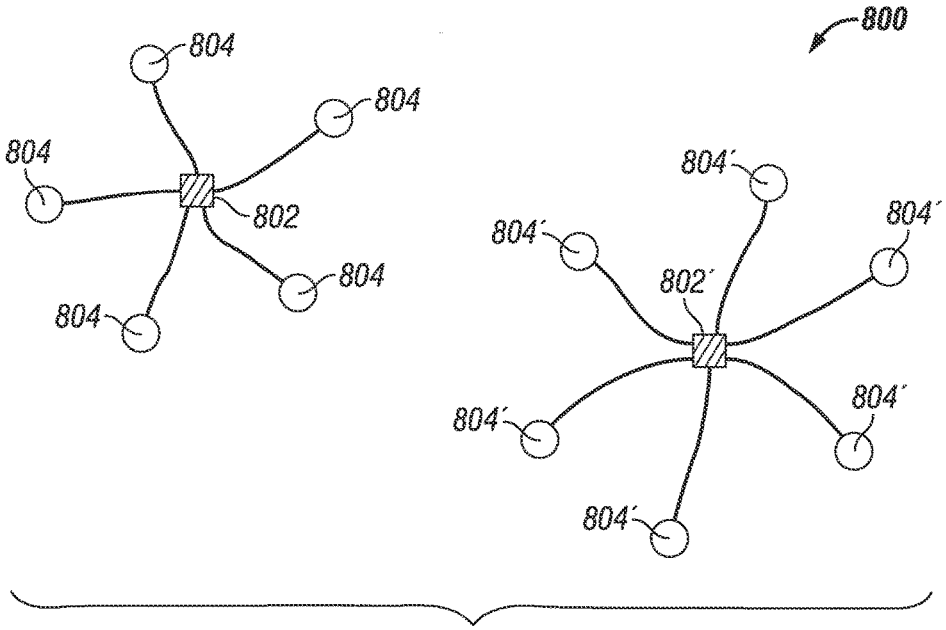
FIG. 13A is a schematic representation of another embodiment of a treatment fluid preparation system.

FIG. 13A illustrates a variation to the treatment fluid preparation and delivery system 200 in FIG. 2. Here, a system 800 is provided which includes a number of wellsites 804 and one or more facilities 802, 802' positioned among a plurality of wellsites 804, 804' in a "hub and spokes" fashion. An example positioning includes a center-of-geography position, a central location, a location minimizing a total trip time between a plurality of wellsites 804, 804' and their corresponding facility 802, 802' and/or any position selected in response to one of the described positions. An example position selected in response to one of the described positions includes a position nominally selected according to a centralization criterion with respect to the wellsites 804, 804' and repositioned specifically to an available location, a pre-existing facility or graded area, minimal social impact, minimal environmental impact, etc. In certain embodiments, the facility 802, 802' is selected to be not greater than a predetermined distance from each of a plurality wellsites 804, 804' such as 5 miles, 10 miles, 15 miles, or 20 miles from each of a plurality of wellsites 804, 804'.

In certain further embodiments, each wellsites 804, 804' is associated with one or more facilities 802, 802'. In certain embodiments, a facility 802, 802' is a fracture fluid manufacturing facility, for example as illustrated in FIGS. 2, 3, and/or 4. In certain embodiments, a facility 802, 802' is an area structured to receive a fracture fluid manufacturing facility, for example as illustrated in FIGS. 2, 3, and/or 4. An example system 800 may also include a fracture fluid manufacturing facility that moves from facility 802 to facility 802' according to the group of wells at wellsites 804, 804' presently being treated.

Figure 13B:
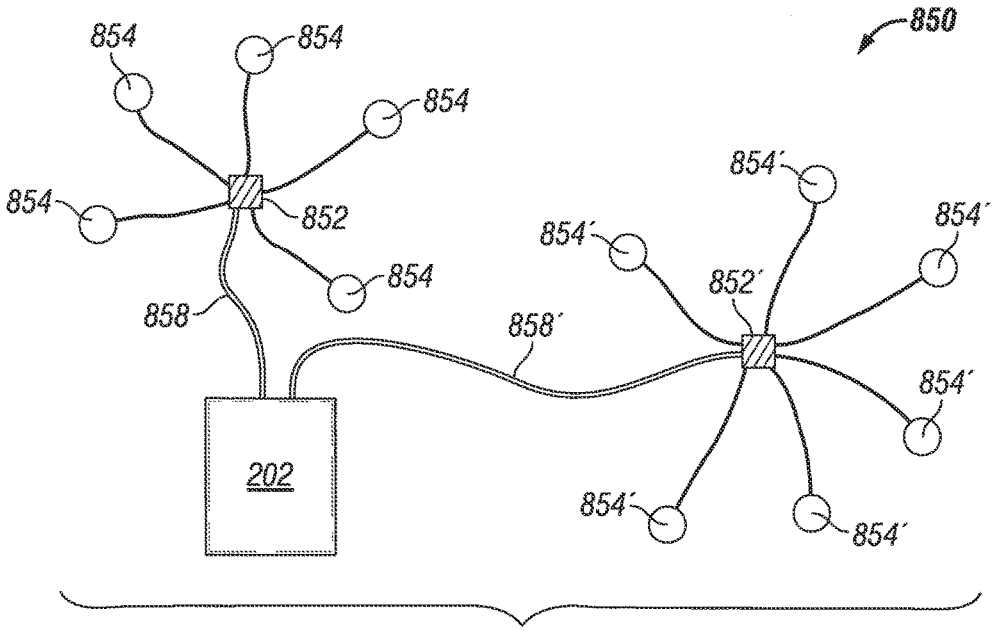
FIG. 13B is a schematic representation of a further embodiment of a treatment fluid preparation system.

FIG. 13B illustrates another variation to the treatment fluid preparation and delivery system 200 in FIG. 2. Here, a system 850 is provided which includes regional blending facility 202 that is functionally connected to one or more local storage facility 852, 852'. The connection 858, 858' between the regional blending facility 202 and the local storage facility 852, 852' can be any vehicle or device, including any type of road access, rail access, barge or boat access, tracked vehicle access, pipelines, etc. The one or more local storage facility is configured to receive the mixed treatment fluid from the regional blending facility and temporarily stores the mixed treatment fluid before usage.

The one or more local storage facilities 852, 852' can be positioned among a plurality of wellsites 854, 854' in a "hub and spokes" fashion. An example positioning includes a center-of-geography position, a central location, a location minimizing a total trip time between a plurality of wellsites 854, 854' and their corresponding local storage facilities 852, 852' and/or any position selected in response to one of the described positions. An example position selected in response to one of the described positions includes a position nominally selected according to a centralization criterion with respect to the wellsites 804, 804' and repositioned specifically to an available location, a pre-existing facility or graded area, minimal social impact, minimal environmental impact, etc. In certain embodiments, the local storage facilities 852, 852' is selected to be not greater than a predetermined distance from each of a plurality wellsites 854, 854' such as 5 miles, 10 miles, 15 miles, or 20 miles from each of a plurality of wellsites 854, 854'.

The system 850 may further include a fluid conduit that fluidly couples a wellsite location with the local storage facility 852, 852', where the fluid conduit is capable to deliver the mixed treatment fluid to the wellsite 854, 854', and/or capable to deliver produced fluid from a wellbore positioned at the wellsite 854, 854' to the local storage facility 852, 852'. The system 850 may further include a fluid conduit that fluidly couples the regional blending facility 202 with the local storage facility 852, 852', where the fluid conduit is capable to deliver the mixed treatment fluid from the regional blending facility 202 to the local storage facility 852, 852', and/or capable to deliver produced fluid from a local storage facility 852, 852' to the regional blending facility 202.

Figure 14:
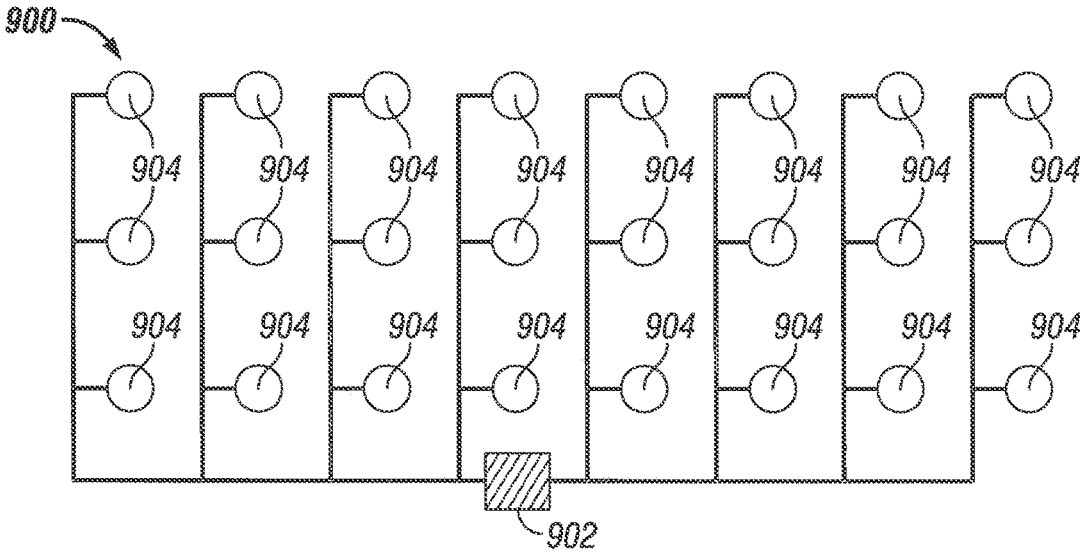
FIG. 14 is a schematic representation of still another embodiment of a treatment fluid preparation system.

FIG. 14 illustrates another variation to the treatment fluid preparation and delivery system 200 in FIG. 2. Here, a system 900 is provided which includes a number of wellsites 904 that are positioned on a single operation site (e.g. a directional drilling PAD), and one or more treatment fluid preparation and delivery facilities 902 positioned on the same operation site. The facility 902 provides pump-ready treatment fluid to the wellsites 904.

In certain embodiments, a method is disclosed for preparing a pump-ready fluid. An example method includes providing a carrier fluid fraction, providing an immiscible substance fraction including a plurality of particles such that a packed volume fraction (PVF) of the particles exceeds 64%, and mixing the carrier fluid fraction and the immiscible substance fraction into a treatment slurry. In certain embodiments, the immiscible substance fraction exceeds 59% by volume of the treatment slurry. In certain embodiments, the immiscible substance fraction exceeds 50% by volume of the treatment slurry. In certain embodiments, the immiscible substance fraction exceeds 40% by volume of the treatment slurry. The method includes providing the treatment slurry to a storage vessel. The storage vessel may be a vessel at a facility 202 or blending plant 400. In certain embodiments, the method includes positioning the storage vessel at a wellsite. In certain embodiments, the storage vessel is not fluidly coupled (in fluid communication) to a wellbore at the wellsite. The storage vessel may be fluidly coupleable to a wellbore at the wellsite, and/or the storage vessel may be a vessel that is transportable to the wellsite, and/or a storage vessel configured to couple to and transfer the pump-ready fluid to a transporting device.

In certain embodiments, the method includes positioning the storage vessel at a wellsite, and/or positioning the storage vessel vertically, for example where the storage vessel is a vertical silo. An example vertical silo includes a frame attached to the silo that deploys the silo from the transport vehicle, and reloads the silo to the transport vehicle after the treatment. Another example vertical silo is a modular and stackable silo, which may include an external frame for the silo. Another example vertical silo is raiseable directly on the transport vehicle, for example as shown in FIG. 10. Certain examples of vertical silos that can be used in the current application are described in U.S. Patent Application Pub. No. US 2011/0063942, and in PCT Patent Application Pub. No. WO 2009/030020 A1, both of which are incorporated herein in the entirety for all purposes.

In certain embodiments, the method includes fluidly coupling the storage vessel to a pump intake, and treating a wellbore with the treatment slurry. In certain embodiments, the method further includes providing all of a proppant amount for the treating of the wellbore within the treatment slurry. Stated differently, in certain embodiments no proppant is added to the treatment slurry after the pump-ready treatment fluid is prepared. Accordingly, the treating equipment omits, in certain embodiments, a proppant delivery vehicle (e.g. sand truck and/or sand Chief) and/or a blender (e.g. a POD blender).

In certain further embodiments, the method includes performing the operations of: providing the carrier fluid fraction, providing the immiscible substance fraction, and mixing the carrier fluid fraction, at a facility remote from a wellsite. The wellsite is any one of the wellsites intended to be served by the facility, and/or intended as the treatment target for the treatment slurry. An example facility includes a powered device to perform at least one of the providing and mixing operations, and an example method further includes capturing a carbon dioxide emission of the powered device. An example capturing operation includes capturing the carbon dioxide emission by injecting the carbon dioxide into a disposal well operationally coupled to the facility, although any carbon capture operation known in the art is contemplated herein. In certain embodiments, the method further includes capturing and disposing of a treatment fluid byproduct at the facility remote from the wellsite. The disposing of the treatment fluid byproduct includes any treating operation to render the treatment fluid byproduct harmless, and/or direct disposal of the treatment fluid byproduct, for example into a disposal well. The disposal well for captured carbon and the disposal well for the treatment fluid byproduct may be the same or distinct wells, and the geological formations for disposal within the disposal well may be the same or distinct formations.

In certain further embodiments, an example method includes selecting a location for the facility remote from the wellsite by selecting a location having an enhanced environmental profile relative to an environmental profile of the wellsite, where the wellsite is an intended treatment target for the treatment slurry. The determination of an enhanced environmental profile may be made with respect to any environmental consideration. Example and non-limiting environmental considerations include zoning, regulatory, situational, and/or amicability considerations. Examples include locating the facility in an industrial zoned area, locating the facility away from environmentally sensitive areas (officially recognized or otherwise), locating the facility where adequate disposal is present or can be made available, locating the facility in an area supported by nearby property owners or local governments, etc.

Figure 15:
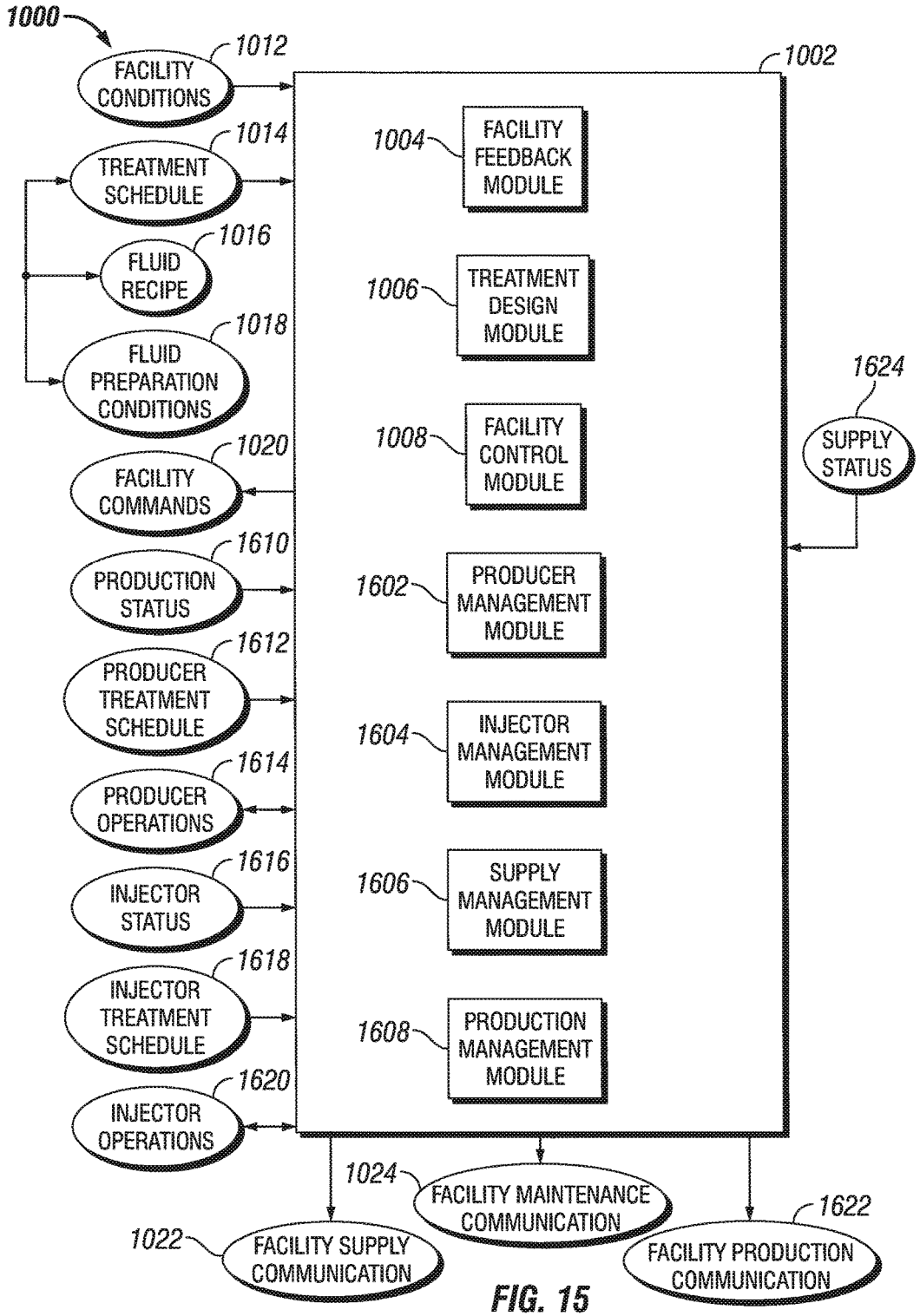
FIG. 15 is a schematic representation of a control unit for the treatment fluid preparation system according to some embodiments of the current application.

Referring to FIG. 15, a control unit 1000 can be included in any of the treatment fluid preparation and delivery system 200, 800, 900, 1100, 1200, 1300, 1400, 1500, 1600 described above. The control facility 1000 can be structured to communicate with and/or control any or all aspects of a facility 202, 802, 902. In certain embodiments, the control unit 1000 can be structured to remotely communicate with and/or control any or all aspects of a facility 202, 802, 902, and/or a blending plant 400. Remote communication and/or control can accomplished through any means understood in the art, including at least wireless, wired, fiber optic, or mixed communications network, and/or through internet or web-based access.

The control unit 1000 may include a controller 1002 structured to functionally execute operations to communicate with and/or control the facility 202, 802, 902. In certain embodiments, the distance of communication exceeds 250 miles, although any other distance can be contemplated. In certain embodiments, the controller 1002 forms a portion of a processing subsystem including one or more computing devices having memory, processing, and communication hardware. The controller 1002 may be a single device or a distributed device, and the functions of the controller may be performed by hardware or software. The controller 1002 may be in communication with any sensors, actuators, i/o devices, and/or other devices that allow the controller to perform any described operations.

In certain embodiments, the controller 1002 may include one or more modules structured to functionally execute the operations of the controller. In certain embodiments, the controller includes facility feedback module 1004, a treatment design module 1006, and a facility control module 1008. An example facility feedback module 1004 may interpret facility conditions, including temperatures, pressures, actuator positions and/or fault conditions, fluid conditions such as fluid density, viscosity, particle volume, etc., and supply indications for various materials at the facility. An example treatment design module 1006 may interpret a treatment schedule, a fluid recipe, and/or fluid preparation conditions. An example facility control module 1008 may provide facility commands in response to the facility conditions and the treatment schedule, wherein one or more actuators or display units at the facility are responsive to the facility commands. In certain embodiments, the controller 1002 further includes a facility maintenance module 1010. An example facility maintenance module 1010 may provide a facility supply communication and/or a facility maintenance communication in response to the facility conditions and/or the treatment schedule.

The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or software on computer readable medium, and modules may be distributed across various hardware or software components. Moreover, certain operations described herein include operations to interpret one or more parameters. Interpreting, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a computer readable medium, receiving the value as a run-time parameter by any means known in the art including operator entry, and/or by receiving a value by which the interpreted parameter can be calculated, and/or by referencing a default value that is interpreted to be the parameter value.

Referencing back to FIG. 15, an example controller 1002 forming a portion of a control unit 1000 is described. The controller 1002 may includes a facility feedback module 1004, a treatment design module 1006, and a facility control module 1008. An example facility feedback module 1004 interprets facility condition(s) 1012. Example and non-limiting facility conditions include any temperature at the facility (e.g. of a fluid, product, ambient temperature, a temperature of any actuator, etc.), any pressure at the facility, a feedback response of any actuator position or state, an amount of any material present at the facility, and measured fluid conditions such as fluid density, viscosity, particle volume, etc., and/or a fault or diagnostic value of any equipment at the facility.

The example controller 1002 further includes a treatment design module 1006. The example treatment design module 1006 interprets a treatment schedule 1014. An example treatment schedule 1014 includes information relevant to a production fluid to be produced at the facility. An example treatment schedule 1014 may include a fluid type, fluid amount, fluid ingredients, and fluid characteristics, such as density, viscosity, particle volume, etc. The fluid type may be a quantitative or qualitative description. The controller 1002 in certain embodiments accesses stored information to determine the formulation of a qualitatively described fluid. In certain embodiments, the treatment schedule 1014 includes a number of fluids, a trajectory of fluids (e.g. a fluid density or proppant density ramp), and/or a sequence of fluids.

In certain embodiments, the treatment schedule 1014 further includes a fluid recipe 1016. An example and non-limiting fluid recipe 1016 may include a list of ingredients to be mixed to provide the pump-ready treatment fluid, the amount of each ingredient, a mixing schedule (e.g. a first particle type to be added first, and a second particle type to be added second, etc.), a gelling schedule, a breaker schedule, a desired fluid density and viscosity, etc. Any fluid formulation information that is actionable by the facility is contemplated herein as a potential aspect of the treatment schedule 1014 and/or fluid recipe 1016. Additionally or alternatively, the treatment schedule 1014 may further include fluid preparation conditions 1018. Example and non-limiting fluid preparation conditions 1018 include fluid shear rates, hydration times, hydration temperatures, etc. In certain embodiments, information may overlap between the fluid recipe 1016 and the fluid preparation conditions 1018.

The example controller 1002 may further include the facility control module 1008. The facility control module 1008 provides facility commands 1020 in response to the facility conditions 1012 and the treatment schedule 1014, the fluid recipe 1016, and/or the fluid preparation conditions 1018. In certain embodiments, the facility commands 1020 are direct commands to actuators of the facility. Additionally or alternatively, the facility commands 1020 provide instructions that indirectly cause operations at the facility—for example communicated information to a display device (computer monitor, printout, etc.). Example facility commands 1020 provide the actions that create the fluid according to the treatment schedule 1014, adjust facility operations according to the measured fluid conditions such as fluid density, viscosity, particle volume, etc., and/or provide the actions that create a fluid acceptably close to the fluid according to the treatment schedule 1014, for example substituting products according to availability, etc.

The example controller 1002 may further include a facility maintenance module 1010 that provides a facility supply communication 1022 and/or a facility maintenance communication 1024 in response to the facility conditions 1012 and/or the treatment schedule 1014 including the fluid recipe 1016 and/or the fluid preparation conditions 1018. An example includes any actuator or sensor fault or diagnostic indicator at the facility may be provided by the facility maintenance module 1010, for example as a facility maintenance communication 1024 that is communicated to notify a maintenance operator of the condition. In certain embodiments, a facility condition 1012 indicating that a fluid constituent is not available in sufficient quantities or is running low may be communicated as a facility supply communication 1022. The described usages of the facility supply communication 1022 and the facility maintenance communication 1024 are examples and non-limiting. Without limitation, any indication that an aspect of the facility is non-functional, degrading, running low, below a predetermined threshold value, and/or of an unknown status may be communicated by the facility maintenance module 1010 and/or controller 1002.

In certain embodiments, the controller 1002 further includes the treatment design module 1006 that interprets a treatment schedule 1014 including a fluid recipe 1016 and fluid preparation conditions 1018, a facility control module 1008 that provides facility commands 1020 in response to the fluid recipe 1016 and fluid preparation conditions 1018, and a production management module 1608 that interprets a production status 1610 corresponding to one of the wellsite locations and provides a facility production communication 1622 in response to the production status 1610. The subsystem for providing the mixed treatment fluid is responsive to the facility commands 1020, and the subsystem for processing the production fluid amount is responsive to the facility production communication 1622.

Example and non-limiting operations of a subsystem for providing the mixed treatment fluid include providing a fluid for a treatment operation on a producer or injector well, and/or providing valve or flow hardware configurations such that fluid conduits between one or more wells are positioned to allow flow from the regional blending facility toward the well. Additional or example operations include providing a stimulation fluid, a wellbore maintenance fluid, a gas lift fluid, and/or any other fluid that is injectable into a wellbore.

Example and non-limiting operations of a subsystem for processing the production fluid amount include determining that a producer well is producing fluid and providing valve or flow hardware configurations such that fluid conduits between one or more wells are positioned to allow flow from the producer well to toward the regional blending facility. Additional or example operations include determining the type of produced fluid and any fluid additives, treatment operations, or other operations indicated according to the type of produced fluid. Further example operations include determining that produced fluid includes treatment flowback fluid for disposal or bypassing around a production fluid facility, determining a gas cut or water cut of produced fluid, and/or reporting information about the produced fluid (quantities, composition, volumes, etc.). Information may be reported, without limitation, to an external device (e.g. datalink, network, etc.), stored on a computer readable medium, and/or displayed on an output device for hard copy storage or manual storage by an operator.

In certain further embodiments, the controller further includes a producer management module 1602 that interprets a producer treatment schedule 1612 and determines producer operations 1614 in response to the producer treatment schedule 1612. The system further includes a subsystem for providing a producer treatment fluid in response to the producer treatment schedule 1612, where the subsystem for providing the producer treatment fluid is responsive to the producer operations 1614. Example and non-limiting examples of producer operations 1614 include shut-in times for a producer well, types and amounts of fluids to provide from a producer treatment schedule 1612, and/or operations to perform tests (e.g. a reservoir pressure test, or a near-wellbore damage diagnostic test) on a producer well. Example and non-limiting producer treatment fluids include a stimulation fluid, a particle securing treatment fluid (e.g. resin, fibers, a sand pack fluid, etc.), a corrosion inhibitor fluid, a well maintenance fluid, a gas lift fluid, a wettability change fluid, and/or a fluid diversion or shutoff fluid. In certain embodiments, the subsystem for providing the producer treatment includes: sources for base fluid, viscosifiers, additives, and particulates; equipment for mixing fluid constituents to produce the producer treatment fluid; and/or equipment for providing the producer treatment fluid to a fluid flow location that is accessible to the fluid conduit. In certain embodiments, the subsystem for providing the producer treatment fluid includes equipment from the regional blending facility, and may be fully included within the regional blending facility, include shared equipment with the regional blending facility, be entirely separate from the regional blending facility, and/or be co-located with the regional blending facility.

The controller may further include an injector management module 1604 that interprets an injector treatment schedule 1618 and determines injector operations 1620 in response to the injector treatment schedule 1618, where subsystem for providing an injector treatment fluid in response to the injector treatment schedule 1618, and where the subsystem for providing the injector treatment fluid is responsive to the injector operations 1620. Example and non-limiting examples of injector operations 1620 include shut-in times for an injector well, types and amounts of fluids to provide from an injector treatment schedule 1618, and/or operations to perform tests (e.g. a reservoir pressure test, a near-wellbore damage diagnostic test, or an injectability test) on an injector well. Example and non-limiting injector treatment fluids include a stimulation fluid, a particle securing treatment fluid (e.g. resin, fibers, a sand pack fluid, etc.), a corrosion inhibitor fluid, a well maintenance fluid, a wettability change fluid, a fluid diversion or shutoff fluid, and/or a sweeping or flushing fluid. In certain embodiments, the subsystem for providing the injector treatment includes: sources for base fluid, viscosifiers, additives, and particulates; equipment for mixing fluid constituents to produce the injector treatment fluid; and/or equipment for providing the injector treatment fluid to a fluid flow location that is accessible to the (second) fluid conduit. In certain embodiments, the subsystem for providing the injector treatment fluid includes equipment from the regional blending facility, and may be fully included within the regional blending facility, include shared equipment with the regional blending facility, be entirely separate from the regional blending facility, and/or be co-located with the regional blending facility.

In certain further embodiments, the system includes each of the wellsites fluidly coupled to the regional blending facility with at least one fluid conduit, where each fluid conduit is capable to deliver the mixed treatment fluid to the wellsite, produced fluid from a wellbore positioned at the wellsite to the regional blending facility, and/or injection fluid to the wellsite. The system may include the facility production command 1622 being a separation command, where the injection fluid includes a separated portion of a produced fluid. The system may include a supply facility that provides at least one particulate material to the bulk receiving facilities, where the supply facility is co-located with the regional blending facility, and the controller includes a supply management module 1606 that interprets a supply status 1624 and the treatment schedule 1014, a producer treatment schedule 1612, and/or an injector treatment schedule 1618. The supply management module 1606 further provides a facility supply communication 1022 in response to the treatment schedule 1014, the producer treatment schedule 1612, and/or the injector treatment schedule 1618—where the supply facility is responsive to the facility supply communication. Example and non-limiting supply status 1624 values include the operability of the supply facility, inventory or supply amount values, rates of production and/or available rates of production, particle availability descriptions, downtime or maintenance descriptions, and/or cost values.

In certain embodiments, a method is disclosed which includes preparing a pump-ready fracturing fluid, delivering the pump-ready fracturing fluid to a location operationally coupled to a wellsite, and pumping the fracturing fluid downhole to fracture a subterranean formation. The pump-ready fracturing fluid may be a fluid that is directly provideable to a pump for high pressure delivery. The pump-ready fracturing fluid may be further conditioned, as additional additives, liquid, etc. may be added to the pump-ready fracturing fluid before or during a formation treatment operation. The method may further include providing the pump-ready fracturing fluid to a positive displacement pump inlet, and pumping the pump-ready fracturing fluid into a wellbore. The method may further include combining pump-ready fracturing fluid sources in a manifold, pressurizing the pump-ready fracturing fluid, and/or providing shear or residence time conditions upstream of the positive displacement pump inlet. In certain embodiments the method includes hydrating, shearing, or conditioning the pump-ready fracturing fluid before the providing the pump-ready fracturing fluid to the positive displacement pump inlet. In certain embodiments, the method includes recirculating a sump side of the positive displacement pump during the pumping. In certain embodiments, the method includes pumping an alternate fluid pill during the pumping, for example alternating to the fluid pill and then back to the pump-ready fracturing fluid.

In certain embodiments, a system is disclosed which includes a regional blending facility that prepares pump-ready treatment fluid for use at a wellsite. The regional blending facility may include bulk receiving facilities that receive and store a number of particle types, each of the number of particle types having a distinct size modality. The facility may include a blending/continuously receiving vessel and a bulk moving device to transfer particle types between the bulk receiving facilities and the blending/continuously receiving vessel. The facility may further include a mixer that receives batched material from the blending/continuously receiving vessel and provides a mixed product fluid, a product storage that stores the mixed product, and a transportation device that delivers the prepared fluid to a wellsite for usage.

In certain embodiments, the bulk receiving facilities may include a mobile receiver that positions under a bulk material carrier, a below grade receiver that allows a bulk material carrier to be positioned thereabove, a depressurized receiver that pneumatically receives bulk material, and/or a receiving area that receives and stores a bulk material carrier in the entirety. In certain embodiments, the bulk moving device may include a pneumatic system utilizing heated air and/or a mechanical bulk transfer device. In certain embodiments, the blending/continuously receiving vessel includes a portion of a batching device, wherein the batching device includes an accumulative batch measurement device, a decumulative batch measurement device, and/or an intermediary vessel sized to be larger than a batch size, where the batching device includes structures for accumulating an amount larger than the batch size in the intermediary vessel, and decumulating the batch size from the intermediary vessel. An example batching device may additionally or alternatively include a number of batch vessels each receiving one of a plurality of distinct product modalities, or each receiving a distinct mix of product modalities.

An example mixing device includes a feed screw operationally coupling the blending/continuously receiving vessel to the product storage, a feed screw operationally coupling the blending/continuously receiving vessel to the product storage, the feed screw including a mixing feature, and/or a feed screw operationally coupling the blending/continuously receiving vessel to the product storage. The feed screw may include a mixing feature, wherein the mixing feature comprises at least one of a tab, a slot, and a hole. Additionally or alternatively, the mixing device may include a drum mixer, a ribbon blender, a twin shaft compulsory mixer, a planetary mixer, a pug mill, a blender (e.g. a POD blender), and/or a colloidal mixer.

In certain embodiments, the product storage may include tanks having a portion with a reduced cross-sectional area, a vessel positioned to gravity feed the wellsite transportation device, a vessel having a head tank, a pressurizable storage vessel, and/or an agitation device. In certain embodiments, the wellsite transportation device is sized in response to a density of the mixed treatment fluid. An example wellsite transportation device may be deployable as a vertical silo, a trailer having an elevated portion, a plurality of trailers having coupled portions, and/or an unfolding trailer.

In certain embodiments, a method is disclosed for preparing a pump-ready fluid. An example method includes providing a carrier fluid fraction, providing an immiscible substance fraction including a plurality of particles such that a packed volume fraction (PVF) of the particles exceeds 64%, mixing the carrier fluid fraction and the immiscible substance fraction into a treatment slurry, and providing the treatment slurry to a storage vessel. The immiscible substance fraction exceeds 59% by volume of the treatment slurry, or 50% by volume of the treatment slurry, or 40% by volume of the treatment slurry. The method may further include positioning the storage vessel at a wellsite, and/or positioning the storage vessel vertically, for example where the storage vessel is a vertical silo. The method may further include fluidly coupling the storage vessel to a pump intake, and treating a wellbore with the treatment slurry. In certain embodiments, the method further includes providing all of a proppant amount for the treating of the wellbore within the treatment slurry. The example method in certain embodiments includes transferring the treatment slurry to a transportation device.

In certain further embodiments, the method includes performing the operations of: providing the carrier fluid fraction, providing the immiscible substance fraction, and mixing the carrier fluid fraction, at a facility remote from a wellsite. The facility includes a powered device to perform at least one of the providing and mixing operations, and the example method further includes capturing a carbon dioxide emission of the powered device. An example capturing operation includes capturing the carbon dioxide emission by injecting the carbon dioxide into a disposal well operationally coupled to the facility. In certain embodiments, the method further includes capturing and disposing of a treatment fluid byproduct at the facility remote from the wellsite. In certain further embodiments, the method includes selecting a location for the facility remote from the wellsite by selecting a location having an enhanced environmental profile relative to an environmental profile of the wellsite, where the wellsite is an intended treatment target for the treatment slurry. In certain further embodiments, the method includes selecting a location for the facility remote from the wellsite by selecting a location having a reduced social impact profile relative to a social impact profile of the wellsite, where the wellsite is an intended treatment target for the treatment slurry.

While the disclosure has provided specific and detailed descriptions to various embodiments, the same is to be considered as illustrative and not restrictive in character. Only certain example embodiments have been shown and described. Those skilled in the art will appreciate that many modifications are possible in the example embodiments without materially departing from the disclosure. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. In the claims, means-plus-function clauses are intended to cover the structures described herein as performing the recited function and not only structural equivalents, but also equivalent structures. For example, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

We claim:

1. A system, comprising:

a regional blending facility comprising:

a plurality of bulk receiving facilities, each of the bulk receiving facilities structured to receive and store a distinct solid particle type having a distinct size modality, wherein the solid particle types in each of the bulk receiving facilities has a distinct size modality from at least one of the other solid particle types in the bulk receiving facilities;

a bulk moving device that transfers the solid particles between the bulk receiving facilities and one of a first vessel and a mixer, the first vessel configured for blending or continuously receiving or both;

a carrying medium vessel;

the mixer structured to:

receive the solid particles from one of the first vessel and the bulk moving device;

receive a carrying medium from the carrying medium vessel;

mix the solid particles with the carrying medium; and provide a mixed treatment fluid; and a fluid conduit that fluidly couples a wellsite location with the regional blending facility, the fluid conduit structured to deliver at least one of:

the mixed treatment fluid to the wellsite; and produced fluid from a wellbore positioned at the wellsite to the regional blending facility.

2. The system of claim 1, further comprising a supply facility structured to provide at least one bulk material to the bulk receiving facilities, and where the supply facility is co-located with the regional blending facility.

3. The system of claim 2, wherein the bulk material is a particulate and wherein the supply facility comprises at least one facility selected from the facilities consisting of a mine, a pit, a digging operation, and a quarry.

4. The system of claim 1, further comprising a production fluid treatment facility structured to receive an amount of production fluid from the wellbore through the fluid conduit, wherein the production fluid treatment facility is further structured to perform at least one treatment operation selected from the treatment operations consisting of: separating the production fluid, settling the production fluid, storing the production fluid, and transmitting the production fluid.

5. The system of claim 4, wherein the production fluid treatment facility is further structured to perform: routing at least a portion of the production fluid to a second fluid conduit that fluidly couples a second wellsite location with the regional blending facility, the system further comprising a second wellbore positioned at the second wellsite, wherein the production fluid treatment facility is co-located with the regional blending facility.

6. The system of claim 1, wherein the regional blending facility is further structured to provide the mixed treatment fluid to the wellsite on at least one of a continuous basis, a batching basis, and a real-time basis.

7. The system of claim 1, further comprising the fluid conduit structured to selectively deliver both the mixed treatment fluid and the produced fluid at distinct times.

8. The system of claim 1, further comprising a local storage facility that is positioned between the regional blending facility and the wellsite, wherein said local storage facility is configured to receive mixed treatment fluid from the regional blending facility, store the mixed treatment fluid, and deliver the mixed treatment fluid to the wellsite.

9. The system of claim 1, wherein the mixed treatment fluid is selected from the group consisting of: a matrix treatment fluid, a water control treatment fluid, a fluid diversion treatment fluid, a stimulation treatment fluid, a cementing fluid, a hydraulic fracturing fluid, a paraffin control treatment fluid, an asphaltene control treatment fluid, a gas lift fluid, and a particulate consolidation treatment fluid.

10. The system of claim 1, wherein the mixed treatment fluid comprises a high solids content fluid.

11. The system of claim 1, wherein each of the solid particle types has a distinct size.

12. A system, comprising:

a regional blending facility comprising:

a mixed treatment fluid subsystem comprising a solid bulk receiving facility and a mixer, the mixed treatment fluid subsystem configured to provide a mixed treatment fluid therefrom, the regional blending facility fluidly coupled to a plurality of wellsite locations; and a production fluid processing subsystem configured to process an amount of production fluid; and a controller, comprising:

a treatment design module structured to interpret a treatment schedule comprising a fluid recipe and fluid preparation conditions;

a facility control module structured to provide facility commands in response to the fluid recipe and fluid preparation conditions;

a production management module structured to interpret a production status corresponding to one of the wellsite locations and to provide a facility production communication in response to the production status; and a producer management module structured to interpret a producer treatment schedule and to determine producer operations in response to the producer treatment schedule, the system further comprising a producer treatment subsystem configured to treat produced fluid in response to the producer treatment schedule, wherein the mixed treatment fluid subsystem is responsive to the facility commands, wherein the production fluid processing subsystem is responsive to the facility production communication, and wherein the producer treatment fluid subsystem is responsive to the producer operations, wherein the regional blending facility further comprises a plurality of bulk receiving facilities, each of the bulk receiving facilities structured to receive and store a distinct solid particle type having a distinct size modality, wherein the solid particle types in each of the bulk receiving facilities has a distinct size modality from at least one of the other solid particle types in the bulk receiving facilities.

13. The system of claim 12, wherein the controller further comprises an injector management module structured to interpret an injector treatment schedule and to determine injector operations in response to the injector treatment schedule, the system further comprising an injector treatment fluid subsystem configured to provide an injector treatment fluid in response to the injector treatment schedule, wherein the injector treatment fluid subsystem is responsive to the injector operations.

14. The system of claim 13, wherein the facility production command comprises a separation command, and wherein the injection fluid comprises a separated portion of a produced fluid.

15. The system of claim 12, wherein each one of the wellsites is fluidly coupled to the regional blending facility with at least one fluid conduit, wherein each fluid conduit is structured to deliver at least one of: the mixed treatment fluid to the wellsite; produced fluid from a wellbore positioned at the wellsite to the regional blending facility; and injection fluid to the wellsite.

16. The system of claim 12, further comprising a supply facility structured to provide at least one particulate material to the bulk receiving facilities, wherein the supply facility is co-located with the regional blending facility, the controller further comprising a supply management module structured to:

interpret a supply status and at least one of the treatment schedule, a producer treatment schedule, and an injector treatment schedule; and provide a facility supply communication in response to the at least one of the treatment schedule, a producer treatment schedule, and an injector treatment schedule; and wherein the supply facility is responsive to the facility supply communication.

17. A method, comprising:

interpreting a treatment schedule for a wellsite;

providing a mixed treatment fluid at a regional blending facility in response to the treatment schedule by combining at least a solid particulate and a fluid;

co-locating the regional blending facility with a supply facility at the wellsite, wherein providing the mixed treatment fluid further comprises transferring at least one amount of solid particulates from the supply facility to the regional blending facility;

moving the mixed treatment fluid through a fluid conduit from the regional blending facility to the wellsite;

producing a fluid from a wellbore at the wellsite; and moving the produced fluid through the fluid conduit from the wellsite to the regional blending facility, wherein the regional blending facility further comprises a plurality of bulk receiving facilities, each of the bulk receiving facilities structured to receive and store a distinct solid particle type having a distinct size modality, wherein the solid particle types in each of the bulk receiving facilities has a distinct size modality from at least one of the other solid particle types in the bulk receiving facilities.

18. The method of claim 17, further comprising separating the production fluid into a first production fluid portion and a second production fluid portion, transmitting the first production fluid portion, and routing the second production fluid portion to a second fluid conduit that fluidly couples a second wellsite location with the regional blending facility.

19. The method of claim 18, further comprising injecting the second production fluid portion into a second wellbore positioned at the second wellsite.

20. The method of claim 17, wherein the providing the mixed treatment fluid comprises continuously providing the mixed treatment fluid during treatment operations at the wellsite.

* * * * *